US009724913B2

(12) United States Patent
Kamiyanagi

(10) Patent No.: US 9,724,913 B2
(45) Date of Patent: Aug. 8, 2017

(54) LIQUID DISCHARGING APPARATUS, HEAD UNIT, AND CONTROL METHOD OF LIQUID DISCHARGING APPARATUS

(71) Applicant: SEIKO EPSON CORPORATION, Tokyo (JP)

(72) Inventor: Masashi Kamiyanagi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/246,710

(22) Filed: Aug. 25, 2016

(65) Prior Publication Data

US 2017/0057225 A1 Mar. 2, 2017

(30) Foreign Application Priority Data

Aug. 31, 2015 (JP) ..... 2015-169925

(51) Int. Cl.
*B41J 2/045* (2006.01)
*B41J 2/165* (2006.01)

(52) U.S. Cl.
CPC ..... *B41J 2/04581* (2013.01); *B41J 2/0451* (2013.01); *B41J 2/04508* (2013.01); *B41J 2/04573* (2013.01); *B41J 2/04588* (2013.01); *B41J 2/04598* (2013.01); *B41J 2/16579* (2013.01); *B41J 2/16585* (2013.01)

(58) Field of Classification Search
CPC .. B41J 2/04581; B41J 2/0451; B41J 2/04588; B41J 2/16579; B41J 2/04573; B41J 2/04598; B41J 2/04508; B41J 2/16585
See application file for complete search history.

(56) References Cited

U.S. PATENT DOCUMENTS 7,150,513 B2 12/2006 Shinkawa et al.
2015/0062219 A1* 3/2015 Otokita ..... B41J 2/04541 347/10

FOREIGN PATENT DOCUMENTS

JP 2004-276544 A 10/2004

* cited by examiner

*Primary Examiner* — Manish S Shah
*Assistant Examiner* — Yaovi M Ameh
(74) *Attorney, Agent, or Firm* — Global IP Counselors, LLP

(57) ABSTRACT

A liquid discharging apparatus includes a driving signal creation section that creates a driving signal, a discharge section provided with a piezoelectric element, and a pressure chamber, and a detection section that is capable of detecting residual vibrations. The driving signal creation section is capable of creating a signal having an inspection waveform of which a potential of a first period is a first potential, a potential of a second period is a second potential, and a potential of a third period is a third potential, as the driving signal. The first potential is a potential that is between the second potential and the third potential, and the internal volume of the pressure chamber in a case in which the driving signal is the second potential is smaller than the internal volume of the pressure chamber in a case in which the driving signal is the third potential.

7 Claims, 18 Drawing Sheets

EXPERIMENTAL VALUES AND CALCULATED VALUES OF RESIDUAL VIBRATIONS (AIR BUBBLE)

EXPERIMENTAL VALUES AND CALCULATED VALUES OF RESIDUAL VIBRATIONS (DRYING)

FIG. 15

| DESIGNATION CONTENT OF SI[m] | SI[m] (b1, b2, b3) | Ts1 | | | Ts2 | | |
|---|---|---|---|---|---|---|---|
| | | Sa[m] | Sb[m] | Sc[m] | Sa[m] | Sb[m] | Sc[m] |
| LARGE DOT | (1, 1, 0) | H | L | L | H | L | L |
| MEDIUM DOT | (1, 0, 0) | H | L | L | L | H | L |
| SMALL DOT | (0, 1, 0) | L | H | L | H | L | L |
| NO RECORDING | (0, 0, 0) | L | H | L | L | H | L |
| DETERMINATION TARGET | (0, 0, 1) | L | L | H | L | L | H |

FIG. 20

| Flag | Tc (COMPARISON CONTENT) | RS |
|---|---|---|
| 1 | Tc < Tth1 | 2: DISCHARGE ABNORMALITY (AIR BUBBLE) |
| | Tth1 ≤ Tc ≤ Tth2 | 1: NORMAL |
| | Tth2 < Tc ≤ Tth3 | 3: DISCHARGE ABNORMALITY (PAPER DUST) |
| | Tth3 < Tc | 4: DISCHARGE ABNORMALITY (THICKENING) |
| 0 | N/A | 5: DISCHARGE ABNORMALITY |

LIQUID DISCHARGING APPARATUS, HEAD UNIT, AND CONTROL METHOD OF LIQUID DISCHARGING APPARATUS

This application claims priority to Japanese Patent Application No. 2015-169925 filed on Aug. 31, 2015. The entire disclosure of Japanese Patent Application No. 2015-169925 is hereby incorporated herein by reference.

BACKGROUND

1. Technical Field

The present invention relates to a liquid discharging apparatus, a head unit, and a control method of a liquid discharging apparatus.

2. Related Art

A liquid discharging apparatus such as an ink jet printer forms images on a recording medium by discharging a liquid such as ink, with which a cavity (a pressure chamber) of a discharge section is filled, as a result of displacing a piezoelectric element provided in the discharge section. In such a liquid discharging apparatus, there are cases in which a discharge abnormality, in which it is no longer possible to normally discharge a liquid from a discharge section, occurs as a result of thickening of the liquid inside a cavity, the incorporation of an air bubble in the cavity or the like. Further, when a discharge abnormality occurs, it is no longer possible to correctly form intended dots, which are formed on a recording medium by a liquid that is discharged from a discharge section, and therefore, the image quality of images that the liquid discharging apparatus forms, is reduced.

In JP-A-2004-276544, a technique that prevents a reduction in image quality due to a discharge abnormality by detecting residual vibrations that occur in a discharge section after displacing a piezoelectric element through driving thereof, and determining a discharge state of a liquid in the discharge section on the basis of the characteristics of the residual vibrations such as the period length and amplitude of the residual vibrations, is suggested.

Incidentally, there are cases in which a liquid is discharged from a discharge section when a piezoelectric element is displaced in order to determine a discharge state of the liquid in the discharge section. In this case, there are problems in that the recording medium can become stained by the discharged liquid, and liquid is consumed in order to determine the discharge state.

Meanwhile, in the determination of a discharge state, in order to prevent the occurrence of problems caused by liquid being discharged from a discharge section, there are cases in which a piezoelectric element is displaced by a small amount of an extent at which liquid is not discharged from the discharge section. However, in this case, the residual vibrations, which are generated in the discharge section, are small, and therefore, there is a problem in that it is no longer possible to correctly determine the discharge state of the liquid in the discharge section.

SUMMARY

An advantage of some aspects of the invention is to provide a technique that correctly determines a discharge state while suppressing the likelihood that liquid will be discharged from a discharge section in a case of determining the discharge state of a liquid in the discharge section.

According to an aspect of the invention, there is provided a liquid discharging apparatus including a driving signal creation section that creates a driving signal, a discharge section provided with a piezoelectric element that is displaced depending on changes in potential of the driving signal, a pressure chamber that causes changes in an internal volume thereof depending on displacement of the piezoelectric element, and a nozzle that is in communication with the pressure chamber, and is capable of discharging a liquid with which inside of the pressure chamber is filled depending on changes in the internal volume of the pressure chamber, and a detection section that is capable of detecting residual vibrations that are generated in the discharge section after displacement of the piezoelectric element. The driving signal creation section is capable of creating a signal having an inspection waveform of which a potential of a first period is a first potential, a potential of a second period, which is after the first period, is a second potential, and a potential of a third period, which is after the second period, is a third potential, as the driving signal. The first potential is a potential that is between the second potential and the third potential, and the internal volume of the pressure chamber in a case in which the driving signal is the second potential is smaller than the internal volume of the pressure chamber in a case in which the driving signal is the third potential.

In this case, the piezoelectric element is displaced in a manner in which the internal volume of the pressure chamber becomes larger in an interval from the end of the second period up to the start of the third period. Therefore, in the third period, for example, it is possible to keep the likelihood that liquid will be discharged from the discharge section low in comparison with the second period.

In addition, in this case, since the first potential is a potential that is between the second potential and the third potential, it is possible to make a difference in potential between the second potential and the third potential greater than a difference in potential between the first potential and the second potential. In other words, it is possible to make an amount of change in the volume of the pressure chamber in an interval from the end of the second period up to the start of the third period greater than an amount of change in the volume of the pressure chamber in an interval from the end of the first period up to the start of the second period. Therefore, in the third period, for example, it is possible to make an amplitude of residual vibrations, which are generated in the discharge section, greater than that of the second period. Accordingly, by determining a discharge state on the basis of residual vibrations in the third period, in comparison with a case in which the discharge state is determined on the basis of residual vibrations in the second period, for example, it is possible to perform correct determination of the discharge state.

In this manner, in this case, it is possible to keep a risk that liquid will be discharged during determination of the discharge state low, and to perform correct determination of the discharge state by increasing the amplitude of the residual vibrations.

In addition, in the liquid discharging apparatus, the detection section may detect residual vibrations, which are being generated in the discharge section, in at least a period of a portion of the third period.

In this case, since the residual vibrations are detected in the third period, it is possible to detect residual vibrations with a larger amplitude than the residual vibrations in the other periods. As a result of this, it is possible to perform correct determination of the discharge state.

In addition, in the liquid discharging apparatus, in the inspection waveform, a potential of a fourth period, which is a period of a portion from the end of the first period up to the start of the second period, may be a fourth potential that is between the first potential and the second potential.

In this case, in an interval from the end of the first period up to the start of the second period, the potential of the driving signal gradually changes as a result of two changes in potential, with the fourth period interposed therebetween, of a change in potential from the first potential to the fourth potential, and a change in potential from the fourth potential to the second potential. Therefore, in comparison with a case of a change in potential from the first potential to the second potential being caused rapidly as a result of a single change in potential, it is possible to keep the amplitude of the residual vibrations in the second period low, and therefore, it is possible to reduce the risk that liquid will be discharged in the second period.

In addition, in the liquid discharging apparatus, in the inspection waveform, a potential of a fifth period, which is after the third period, may be a fifth potential, a potential of a sixth period, which is after the fifth period, may be the first potential, and the fifth potential may be a potential that is between the first potential and the third potential.

In this case, in an interval from the end of the third period up to the start of the sixth period, the potential of the driving signal gradually changes as a result of two changes in potential, with the fifth period interposed therebetween, of a change in potential from the third potential to the fifth potential, and a change in potential from the fifth potential to the first potential. Therefore, in comparison with a case of a change in potential from the third potential to the first potential being caused rapidly as a result of a single change in potential, it is possible to keep the amplitude of the residual vibrations in the sixth period low, and therefore, it is possible to reduce the risk that liquid will be discharged in the sixth period.

In addition, in the liquid discharging apparatus, in the inspection waveform, a potential of a sixth period, which is after the third period, may be the first potential, and a difference in potential between the first potential and the second potential may be greater than a difference in potential between the first potential and the third potential.

In this case, it is possible to make an amount of change in the volume of the pressure chamber in an interval from the end of the third period up to the start of the sixth period smaller than an amount of change in the volume of the pressure chamber in an interval from the end of the first period up to the start of the second period. That is, it is possible to keep the amplitude of the residual vibrations, which are generated as a result of changes in the volume of the pressure chamber in an interval from the end of the third period up to the start of the sixth period, low. More specifically, it is possible to keep the amplitude of the residual vibrations in the sixth period low in comparison with the amplitude of the residual vibrations in the second period and the amplitude of the residual vibrations in the third period.

In addition, in this case, a potential of the piezoelectric element that increases the volume of the pressure chamber in an interval from the end of the second period up to the start of the third period, and a potential of the piezoelectric element that decreases the volume of the pressure chamber in an interval from the end of the third period up to the start of the sixth period are inverse potentials. Therefore, it is possible to suppress residual vibrations, which are generated as a result of changes in the volume of the pressure chamber from the end of the second period up to the start of the third period, using vibrations that are generated as a result of changes in the volume of the pressure chamber in an interval from the end of the third period up to the start of the sixth period.

As a result of such features, it is possible to obtain the following effects. Firstly, in a case in which the determination of the discharge state in one discharge section is performed before the sixth period, and the discharge of liquid (printing) is executed from the one discharge section or another discharge section from the sixth period onwards with the aim of forming images on a recording medium, it is possible to keep an effect that the residual vibrations used in the determination of the discharge state, which was carried out on the one discharge section before the sixth period, have on printing from the sixth period onwards, low. In other words, a first effect is related to keeping the effect that the determination of the discharge state brings about on printing quality, low. Secondly, in a case in which the determination of the discharge state in one discharge section is executed before the sixth period (referred to as a "former determination"), and the determination of the discharge state in the one discharge section or another discharge section is performed from the sixth period onwards (referred to as a "latter determination"), it is possible to keep an effect that the residual vibrations used in the former determination, which was carried out on the one discharge section, have on the latter determination, low. In other words, a second effect is related to the fact that it is also possible to perform correct determination in a case in which determination of the discharge state is executed a plurality of times.

According to another aspect of the invention, there is provided a head unit including a driving signal creation section that creates a driving signal, a discharge section provided with a piezoelectric element that is displaced depending on changes in potential of the driving signal, a pressure chamber that causes changes in an internal volume thereof depending on displacement of the piezoelectric element, and a nozzle that is in communication with the pressure chamber, and is capable of discharging a liquid with which inside of the pressure chamber is filled depending on changes in the internal volume of the pressure chamber, and a detection section that is capable of detecting residual vibrations that are generated in the discharge section after displacement of the piezoelectric element. The driving signal creation section is capable of creating a signal having an inspection waveform of which a potential of a first period is a first potential, a potential of a second period, which is after the first period, is a second potential, and a potential of a third period, which is after the second period, is a third potential, as the driving signal. The first potential is a potential that is between the second potential and the third potential, and the internal volume of the pressure chamber in a case in which the driving signal is the second potential is smaller than the internal volume of the pressure chamber in a case in which the driving signal is the third potential.

In this case, it is possible to keep a risk that liquid will be discharged during determination of the discharge state low, and to perform correct determination of the discharge state by increasing the amplitude of the residual vibrations.

In addition, according to still another aspect of the invention, there is provided a control method of a liquid discharging apparatus provided with a discharge section including a piezoelectric element that is displaced depending on changes in potential of a driving signal, a pressure chamber that causes changes in an internal volume thereof depending on displacement of the piezoelectric element, and a nozzle that is in communication with the pressure chamber, and is capable of discharging a liquid with which inside of the pressure chamber is filled depending on changes in the internal volume of the pressure chamber, and a detection section that is capable of detecting residual vibrations that are generated in the discharge section after displacement of the piezoelectric element. The method includes supplying a signal having an inspection waveform in which a potential of a first period is a first potential, a potential of a second period, which is after the first period, is a second potential, and a potential of a third period, which is after the second period, is a third potential, to the piezoelectric element as the driving signal. The first potential is a potential that is between the second potential and the third potential, and the internal volume of the pressure chamber in a case in which the driving signal is the second potential is smaller than the internal volume of the pressure chamber in a case in which the driving signal is the third potential.

In this case, it is possible to keep a risk that liquid will be discharged during determination of the discharge state low, and to perform correct determination of the discharge state by increasing the amplitude of the residual vibrations.

BRIEF DESCRIPTION OF THE DRAWINGS

The invention will be described with reference to the accompanying drawings, wherein like numbers reference like elements.

FIG. 15 is an explanatory drawing that shows decoding contents of a decoder.

FIG. 20 is an explanatory diagram for describing determination information.

DESCRIPTION OF EXEMPLARY EMBODIMENTS

Hereinafter, aspects for implementing the invention will be described with reference to the drawings. However, in each figure, the dimensions and scales of each part have been altered from practical dimensions and scales as appropriate. In addition, since the embodiment that is mentioned below is a preferred specific example of the invention, various technically preferable limitations have been applied thereto, but the scope of the invention is not limited to these embodiments unless a feature that specifically limits the invention is disclosed in the following description.

A. EMBODIMENT

In the present embodiment, a liquid discharging apparatus will be described by illustrating an ink jet printer that forms images on recording sheets P (an example of a "medium") by discharging ink (an example of a "liquid"), by way of example.

1. Outline of Printing System

The configuration of an ink jet printer 1 according to the present embodiment will be described with reference to FIGS. 1 and 2.

Figure 1:
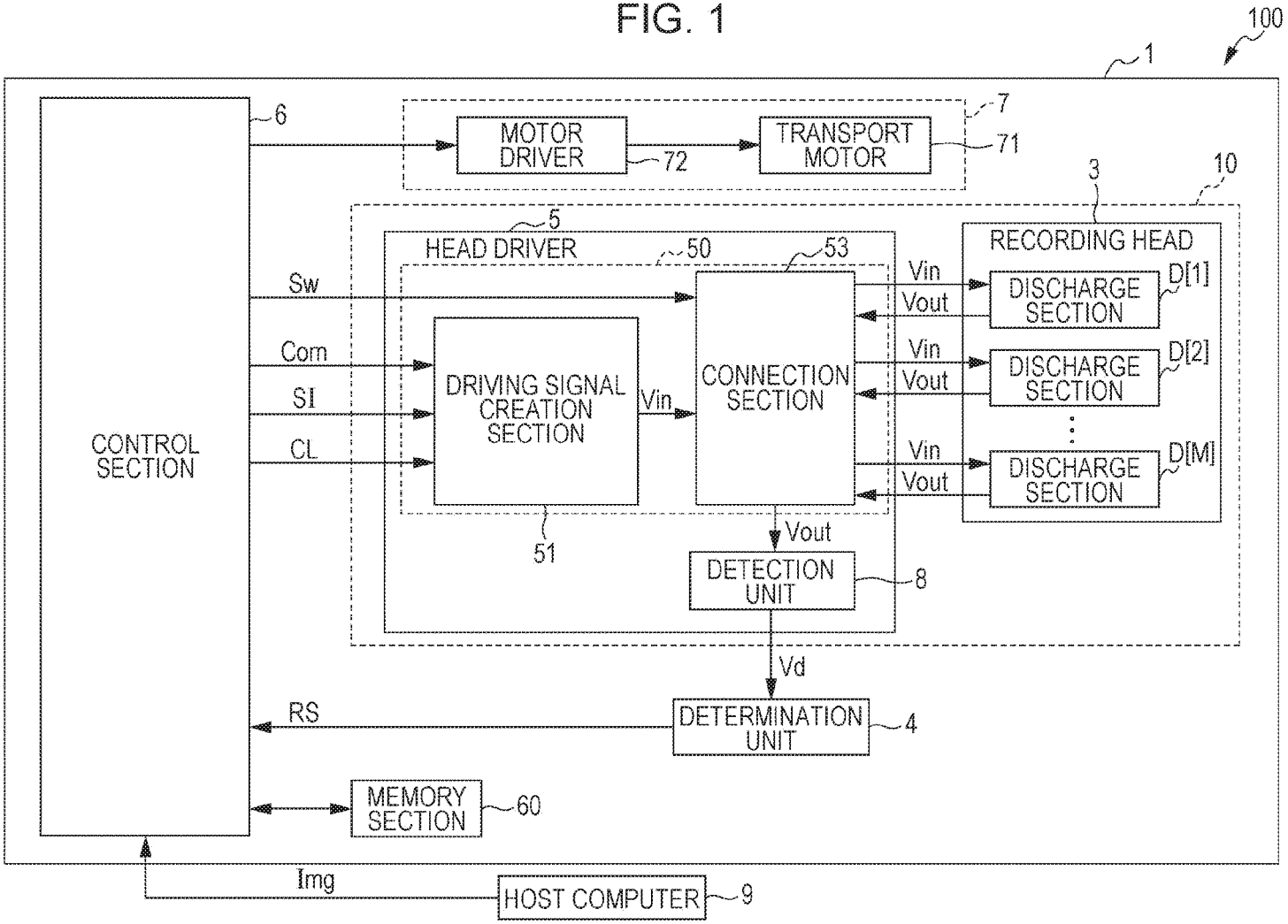
FIG. 1 is a block diagram that shows a configuration of a printing system according to an embodiment of the invention.

FIG. 1 is a functional block diagram that shows a configuration of a printing system 100, which is installed in the ink jet printer 1. The printing system 100 is provided with a host computer 9 such as a personal computer or a digital camera, and the ink jet printer 1.

The host computer 9 outputs printing data Img, which shows images that the ink jet printer 1 should form, and information that shows a printing copy number of images that the ink jet printer 1 should form.

The ink jet printer 1 executes a printing process that forms images, which are shown by the printing data Img supplied from the host computer 9, a required number of times on recording sheets P. Additionally, in the present embodiment, description will be given illustrating a case in which the ink jet printer 1 is a line printer, by way of example.

As shown in FIG. 1, the ink jet printer 1 is provided with a head unit 10, in which discharge sections D that discharge ink, are provided, a determination unit 4 (there are cases in which this is referred to as a "determination section") that determines discharge states of the ink from the discharge sections D, a transport mechanism 7 for changing a relative position of the recording sheets P with respect to the head unit 10, a control section 6 that controls the actions of each section of ink jet printer 1, and a memory section 60 that stores a control program of the ink jet printer 1 and other information.

Additionally, although illustration thereof is omitted, the ink jet printer 1 may be provided with a maintenance mechanism (not illustrated in the drawing) that, in a case in which there is a discharge abnormality in a discharge section D, executes a maintenance process that restores the discharge state of the ink in the corresponding discharge section D to normal, a display section that displays error messages, and the like, and a display operation section (not illustrated in the drawing), in which an operation section for a user of the ink jet printer 1 to input various commands, or the like into the ink jet printer 1, is installed.

Figure 2:
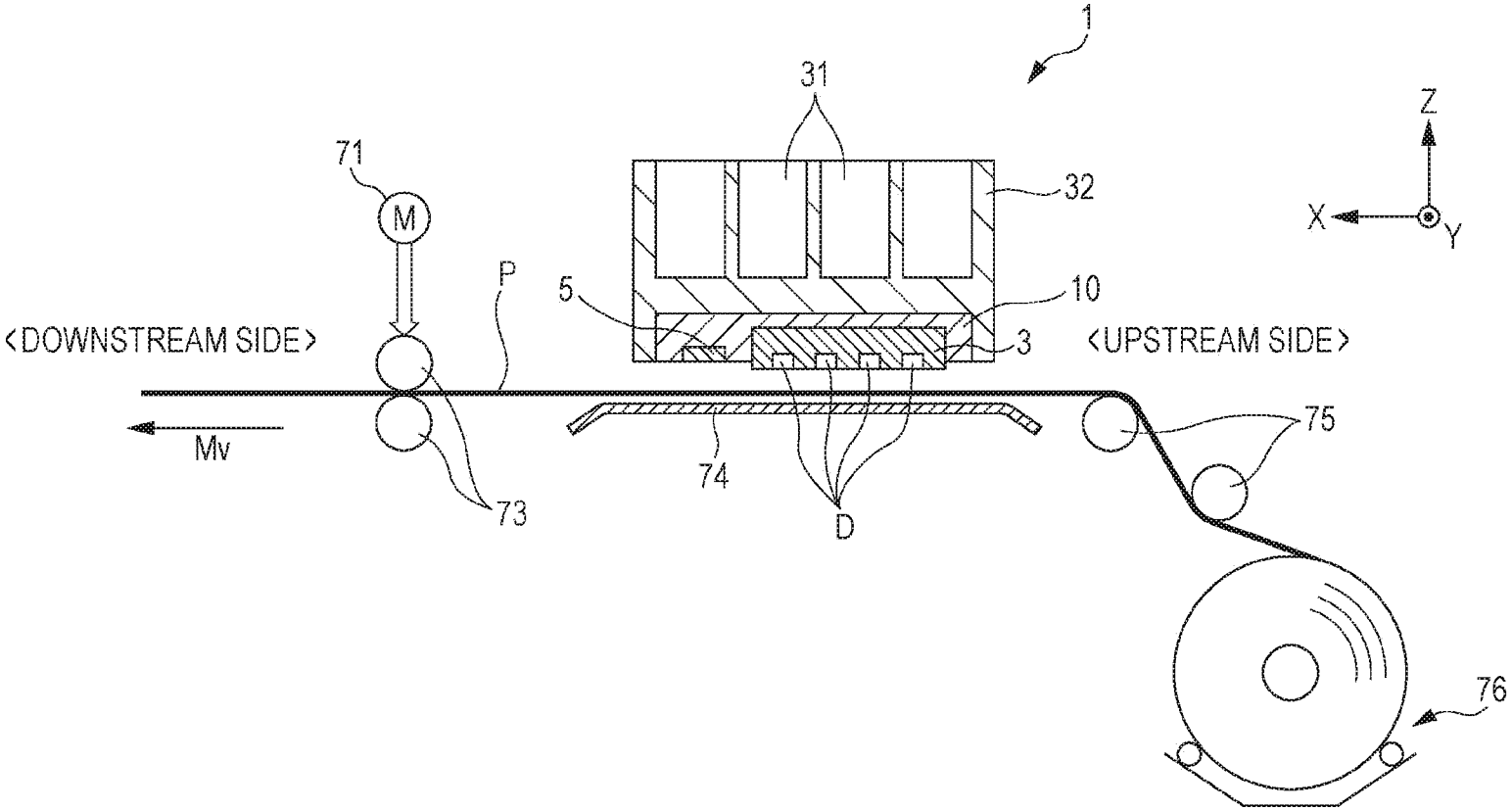
FIG. 2 is a schematic partial cross-sectional view of an ink jet printer.

FIG. 2 is a partial cross-sectional view that illustrates a schematic of an internal configuration of the ink jet printer 1 by way of example.

As shown in FIG. 2, the ink jet printer 1 is provided with a mounting mechanism 32 for mounting the head unit 10. In addition to the head unit 10, four ink cartridges 31 are mounted in the mounting mechanism 32. The four ink cartridges 31 are provided to correspond to the four colors (CMYK) of black, cyan, magenta, and yellow on a one-to-one basis, and each ink cartridge 31 is filled with an ink of a color that corresponds to the corresponding ink cartridge 31. Additionally, a configuration in which each ink cartridge 31 is provided in a separate site of the ink jet printer 1 instead of being mounted in the mounting mechanism 32, may also be used.

As shown in FIG. 1, the transport mechanism 7 is provided with a transport motor 71, which functions as a driving source for transporting the recording sheets P, and a motor driver 72 for driving the transport motor 71. In addition, as shown in FIG. 2, the transport mechanism 7 is provided with a platen 74 that is provided on a lower side (a −Z direction in FIG. 2) of the mounting mechanism 32, transport rollers 73 that rotate as a result of the action of the transport motor 71, guide rollers 75 that are provided so as to be capable of freely rotating around a Y axis in FIG. 2, and an accommodation section 76 for accommodating the recording sheets P in a state of being wound up in roll form. In a case in which the ink jet printer 1 executes a printing process, the transport mechanism 7 feeds out the recording sheets P from the accommodation section 76, and transports the recording sheets P in a direction from an upstream side toward a downstream side along a transport pathway that is defined by the guide rollers 75, the platen 74 and the transport rollers 73 at a transport speed Mv, for example. Additionally, hereinafter, as shown in FIG. 2, a direction in the transport pathway from the upstream side toward the downstream side is referred to as a +X direction, and a direction from the downstream side to the upstream side is referred to as a −X direction. In addition, hereinafter, there are cases in which the +X direction and the −X direction will be collectively referred to as an X axis direction.

The memory section 60 is provided with EEPROM (Electrically Erasable Programmable Read-Only Memory), which is a type of non-volatile semiconductor memory that stores the printing data Img, which is supplied from the host computer 9, RAM (Random Access Memory) that temporarily stores data that is required when executing various processes such as the printing process, or temporarily develops a control program for executing various process such as the printing process, and PROM, which is a type of non-volatile semiconductor memory that stores a control program for controlling each section of the ink jet printer 1.

The control section 6 is configured to include a CPU (Central Processing Unit), an FPGA (field-programmable gate array) and the like, and the CPU controls the actions of each section of the ink jet printer 1 by acting in accordance with the control program stored in the memory section 60.

Further, the control section 6 controls the execution of a printing process, which forms images that depend on the printing data Img on the recording sheets P, by controlling the head unit 10 and the transport mechanism 7 on the basis of the printing data Img that is supplied from the host computer 9, and the like.

More specifically, firstly, in the printing process, the control section 6 stores the printing data Img, which is supplied from the host computer 9, in the memory section 60. Next, in the printing process, the control section 6 creates signals such as a printing signal SI, a driving waveform signal Com, and the like for driving the discharge sections D by controlling the actions of the head unit 10 on the basis of various data such as the printing data Img that is stored in the memory section 60. In addition, in the printing process, the control section 6 creates a signal for controlling the actions of the motor driver 72 on the basis of the printing signal SI and various data that is stored in the memory section 60, and outputs the various created signals. Additionally, although described in more detail later, the driving waveform signal Com according to the present embodiment includes driving waveform signals Com-A, Com-B and Com-C.

Incidentally, the driving waveform signal Com is an analog signal. Therefore, in addition to the CPU, the control section 6 includes a DA conversion circuit, which is not illustrated in the drawings, and outputs a digital driving waveform signal, which is created in the CPU, or the like, that the control section 6 is provided with, after conversion into an analog driving waveform signal Com.

In this manner, in the printing process, the control section 6 drives the transport motor 71 in a manner in which the recording sheets P are transported in the +X direction using the control of the motor driver 72, and, in addition, controls the presence or absence of discharge from each discharge section D, a discharge amount of ink, the discharge timing of ink, and the like, using the control of the head unit 10. That is, the control section 6 adjusts a dot size and dot disposition that is formed by ink that is discharged onto the recording sheets P, and controls each section of the ink jet printer 1 in a manner in which the printing process that forms images, which correspond to the printing data Img on the recording sheets P, is executed.

Additionally, although described in more detail later, the control section 6 controls each section of the ink jet printer 1 in a manner in which a discharge state determination process, which determines whether or not the discharge state of the ink from each discharge section D is normal, that is, whether or not there is a discharge abnormality in each discharge section D.

In this instance, a discharge abnormality refers to a state in which the discharge state of the ink in the discharge sections D is abnormal, or in other words, a state in which it is not possible to correctly discharge the ink from the nozzles N (refer to FIGS. 3 and 4, which will be described later), which are installed in the discharge sections D. More specifically, discharge abnormalities include a state in which the discharge sections D cannot discharge the ink, a state in which the discharge sections D cannot discharge an amount of the ink that is required in order to form an image, which is shown by the printing data Img, as a result of a discharge amount of ink being small even in a case in which it is possible to discharge the ink from the discharge sections D, a state in which an amount of the ink that is required in order to form an image, which is shown by the printing data Img, or more is discharged from the discharge sections D, a state in which the ink, which is discharged from the discharge sections D, lands in a position that differs from a predetermined landing position in order to form an image, which is shown by the printing data Img, and the like.

Additionally, in a case in which there is a discharge abnormality in the discharge sections D, if the maintenance mechanism is installed in the ink jet printer 1, the discharge state of the ink in a discharge section D may be restored to normal by executing the maintenance process using the maintenance mechanism. In this instance, the maintenance process is a process that returns the discharge state in a discharge section D to normal by newly supplying the ink to the discharge section D from the ink cartridges 31 after ejecting the ink inside the corresponding discharge section D, and examples of such a process include a flushing process that performs preliminary discharge of the ink from a discharge section D, a pumping process that suctions ink, air bubbles, or the like, which has thickened inside the discharge section D, using a tube pump (not illustrated in the drawings), and the like.

As shown in FIG. 1, the head unit 10 is provided with a recording head 3, in which M discharge sections D are equipped, and the head driver 5 that drives each discharge section D, which is installed in the recording head 3 (in the present embodiment, M is a nonnegative integer that satisfies 4<M). Additionally, hereinafter, there are cases in which the respective M discharge sections D are referred to, in order, as a first stage, a second stage, . . . , and an $m^{th}$ stage to discriminate therebetween. In addition, hereinafter, there are cases in which a discharge section D of an $m^{th}$ stage is referred to using the term discharge section D[m] (a variable m is a nonnegative integer that satisfies $1 \leq m \leq M$).

The M discharge sections D are divided into four groups to correspond to the four ink cartridges 31 on a one-to-one basis. Each discharge section D receives the supply of the ink from the ink cartridge 31 that corresponds to the group to which the corresponding discharge section D belongs. The inside of each discharge section D is filled with the ink, supplied from the ink cartridges 31, and each discharge section D can discharge the ink, with which it is filled, from the nozzle N, which is installed in the corresponding discharge section D. Therefore, each discharge section D is capable of discharging the ink onto the recording sheets P at a timing with which the transport mechanism 7 transports the recording sheets P onto the platen 74, and as a result of this, can form dots for configuring images on the recording sheets P. Further, full color printing is realized by discharging ink of the four colors of CMYK overall from the M discharge sections D, which are provided in the head unit 10.

As shown in FIG. 1, the head driver 5 is provided with a driving signal supply section 50 (there are cases in which this is referred to as a "supply section") that supplies driving signals Vin for respectively driving the M discharge sections D, which the recording head 3 is provided with, to each discharge section D, and a detection unit 8 (an example of a "detection section") that detects residual vibrations that are generated in the discharge sections D after the corresponding discharge sections D are driven by the driving signals Vin.

Additionally, hereinafter, among the M discharge sections D, there are cases in which a discharge section D that is a target of the detection of residual vibrations by the detection unit 8, is referred to as a target discharge section Dtg. Although described in more detail later, a target discharge section Dtg is designated from among the M discharge sections D by the control section 6.

The driving signal supply section 50 is provided with a driving signal creation section 51 and a connection section 53.

The driving signal creation section 51 creates the driving signals Vin for respectively driving the M discharge sections D, which the recording head 3 is provided with, on the basis of signals such as the printing signal SI, a clock signal CL, and the driving waveform signal Com, which are supplied from the control section 6.

The connection section 53 electrically connects each discharge section D to either one of the driving signal creation section 51 and the detection unit 8 on the basis of a connection control signal Sw that is supplied from the control section 6. The driving signals Vin, which are created in the driving signal creation section 51, are supplied to the discharge sections D via the connection section 53. When the driving signals Vin are supplied, each discharge section D is driven on the basis of the supplied driving signal Vin, and it is possible to discharge the ink, with which the inside of the discharge sections D is filled, onto the recording sheets P.

The detection unit 8 detects a residual vibration signal Vout, which shows residual vibrations that are generated in a discharge section D designated as a target discharge section Dtg after the corresponding discharge section D is driven by the driving signal Vin. Further, the detection unit 8 creates a shaped waveform signal Vd by carrying out processes such as removing a noise component, amplifying the signal level, and the like of a detected residual vibration signal Vout, and outputs the created shaped waveform signal Vd. Additionally, in the present embodiment, the driving signal supply section 50 and the detection unit 8 are, for example, mounted as an electronic circuit on a substrate that is provided in the head unit 10.

The determination unit 4 determines the discharge state of the ink in a discharge section D designated as a target discharge section Dtg on the basis of the shaped waveform signal Vd that the detection unit 8 outputs, and creates determination information RS, which shows a corresponding determination result. In the present embodiment, determination unit 4 is, for example, mounted as an electronic circuit on a substrate that is provided in a location that differs from that of the head unit 10.

Additionally, the above-mentioned discharge state determination process includes a series of processes, which the ink jet printer 1 executes, of the control section 6 designating a target discharge section Dtg from among the M discharge sections D, the detection unit 8 creating a shaped waveform signal Vd, which shows a detection result of the residual vibrations that are generated in the target discharge section Dtg, and the determination unit 4 creating the determination information RS on the basis of the detected residual vibration signal Vout.

Additionally, hereinafter, there are cases in which description is given by adding a suffix [m], which refers to a stage number m, to the symbols that indicate constituent elements or information that corresponds to a stage number, and examples of such cases include the determination information RS that shows the discharge state of the ink in a discharge section D[m] being referred to as determination information RS[m], the driving signal Vin that is supplied to a discharge section D[m] being referred to as a driving signal Vin[m], and the like.

2. Configuration of Recording Head

The recording head 3 and the discharge sections D that are provided in the recording head 3 will be described with reference to FIGS. 3 and 4.

Figure 3:
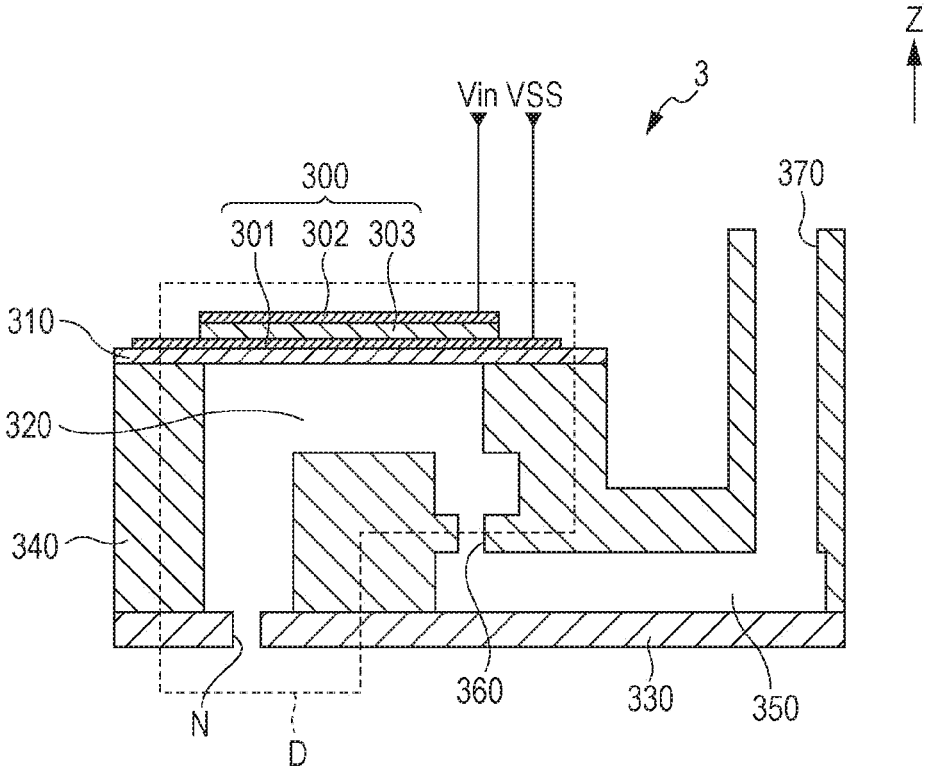
FIG. 3 is a schematic cross-sectional view of a recording head.

FIG. 3 is an example of a schematic partial cross-sectional view of the recording head 3. Additionally, a single discharge section D of the M discharge sections D that the recording head 3 includes, a reservoir 350 that is in communication with the corresponding single discharge section D through an ink supply opening 360, and an ink intake opening 370 for supplying the ink to the reservoir 350 from the ink cartridges 31, are shown in the figure, for the convenience of illustration.

As shown in FIG. 3, the discharge section D is provided with a piezoelectric element 300, a cavity 320 (an example of a "pressure chamber"), the inside of which is filled with the ink, a nozzle N that is in communication with the cavity 320, and a vibration plate 310. The discharge section D discharges the ink that is inside the cavity 320 from the nozzle N as a result of the piezoelectric element 300 being driven by the driving signal Vin. The cavity 320 is a space that is partitioned by a cavity plate 340, a nozzle plate 330 in which the nozzle N is formed, and the vibration plate 310. The cavity 320 is in communication with the reservoir 350 through the ink supply opening 360. The reservoir 350 is in communication with a single ink cartridge 31 through the ink intake opening 370.

In the present embodiment, for example, a unimorph (monomorph) type piezoelectric element of the manner shown in FIG. 3, is adopted as the piezoelectric element 300, but the piezoelectric element 300 may be any kind of piezoelectric element, such as a bimorph type, a lamination type or the like, as long as the piezoelectric element 300 can be deformed by the driving signal Vin. The piezoelectric element 300 includes a lower section electrode 301, an upper section electrode 302, and a piezoelectric body 303 that is provided between the lower section electrode 301 and the upper section electrode 302. Further, when a voltage is applied between the lower section electrode 301 and the upper section electrode 302 as a result of the potential of the lower section electrode 301 being set to a predetermined potential VSS, and the driving signal Vin being supplied to the upper section electrode 302, the piezoelectric element 300 is displaced in the +Z direction and the −Z direction (hereinafter, the +Z direction and the −Z direction will be collectively referred to as a "Z axis direction") depending on the corresponding voltage that is applied, and the piezoelectric element 300 vibrates as a result.

The vibration plate 310 is installed in an upper surface aperture section of the cavity plate 340, and the lower section electrode 301 is joined to the vibration plate 310. Therefore, when the piezoelectric element 300 vibrates due to the driving signal Vin, the vibration plate 310 also vibrates. Further, a volume of the cavity 320 (the pressure inside the cavity 320) changes due to the vibrations of the vibration plate 310, and ink, with which the inside of the cavity 320 is filled, is discharged through the nozzle N. In a case in which the ink inside the cavity 320 is reduced due to discharge of the ink, the ink is supplied from the reservoir 350. In addition, the ink is supplied from the ink cartridges 31 to the reservoir 350 through the ink intake opening 370.

Figure 4:
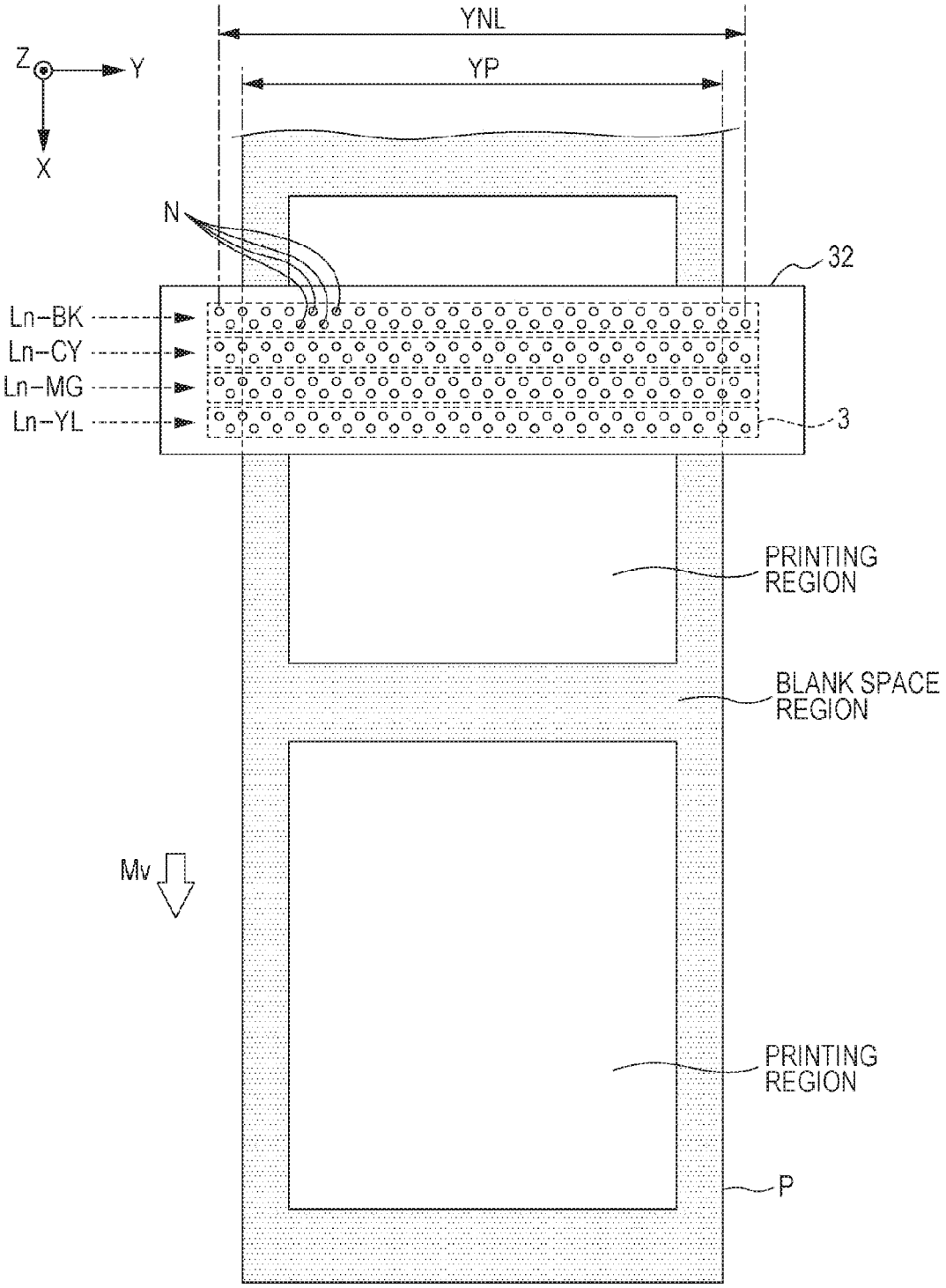
FIG. 4 is a plan view that shows an arrangement example of nozzles in the recording head.

FIG. 4 is an explanatory drawing for describing an example of the disposition of M nozzles N that are provided in the recording head 3, which is mounted in the mounting mechanism 32, in a case in which the ink jet printer 1 is viewed in plan view from the +Z direction or the −Z direction.

As shown in FIG. 4, four nozzle rows Ln, which are formed from a nozzle row Ln-BK formed from a plurality of nozzles N, a nozzle row Ln-CY formed from a plurality of nozzles N, a nozzle row Ln-MG formed from a plurality of nozzles N, and a nozzle row Ln-YL formed from a plurality of nozzles N, are included in the recording head 3. Additionally, the nozzles N that belong to the nozzle row Ln-BK are nozzles N that are provided in a discharge section D that discharges black ink (a discharge section D that belongs to the group that corresponds to the ink cartridge 31 that is filled with black ink), the nozzles N that belong to the nozzle row Ln-CY are nozzles N that are provided in a discharge section D that discharges cyan ink, the nozzles N that belong to the nozzle row Ln-MG are nozzles N that are provided in a discharge section D that discharges magenta ink and the nozzles N that belong to the nozzle row Ln-YL are nozzles N that are provided in a discharge section D that discharges yellow ink. In addition, in the present embodiment, the respective four nozzle rows Ln are provided so as to extend in a +Y direction or a −Y direction (hereinafter, the +Y direction and the −Y direction will be collectively referred to as a "Y axis direction") when viewed in plan view. Further, a range YNL over which each nozzle row Ln extends in the Y axis direction is a range YP or more in the Y axis direction of the corresponding recording sheets P in a case of printing on the recording sheets P (to be precise, among the recording sheets P, recording sheets P for which the width in the Y axis direction is a maximum width on which printing with the ink jet printer 1 is possible).

As shown in FIG. 4, the plurality of nozzles N that belong to each nozzle row Ln are disposed in a so-called zig-zag shape so that the positions in the X axis direction from the −Y side of even-numbered nozzles N and odd-numbered nozzles N differ from one another. However, the disposition of the nozzles N that is shown in FIG. 4 is an example, and each nozzle row Ln may extend in a direction that differs from the Y axis direction, or a plurality of nozzles N that belong to each nozzle row Ln may be disposed in a linear manner.

Additionally, as an example, as shown in FIG. 4, the printing process in the present embodiment divides the recording sheets P into a plurality of printing regions (for example, corresponding A4 sized rectangular regions in a case of printing an A4 sized image on the recording sheets P, or a label on label sheets), and a plurality of blank space regions for respectively partitioning the plurality of printing regions, and assumes a case of forming a plurality of images that correspond to the plurality of printing regions on a one-to-one basis.

However, a single printing region may be provided for a single recording sheet P, and a single image may respectively be formed on a plurality of recording sheets P that corresponds to the printing copy number.

3. Actions and Residual Vibrations of Discharge Sections

Next, an ink discharge action from the discharge sections D, and the residual vibrations that occur in the discharge sections D will be described with reference to FIGS. 5 to 13.

Figure 5:
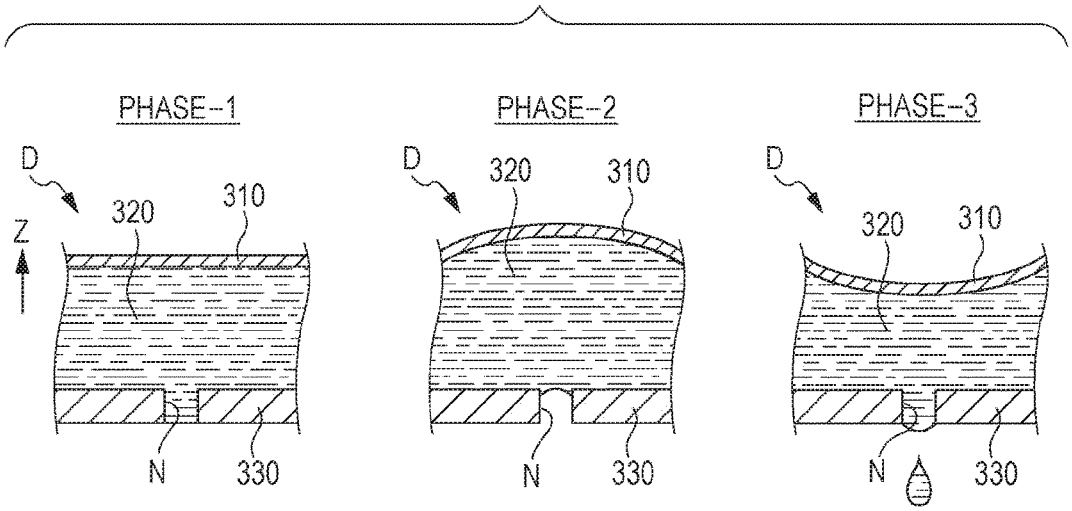
FIG. 5 is an explanatory diagram that shows cross-sectional shapes of a discharge section during driving according to a driving signal.

FIG. 5 is an explanatory diagram for describing an ink discharge action from a discharge section D. As shown in FIG. 5, for example, in a state of Phase-1, distortion that displaces a piezoelectric element 300, which a discharge section D is provided with, in the +Z direction, is generated as a result of the driving signal creation section 51 changing the potential of the driving signal Vin, which is supplied to the corresponding piezoelectric element 300, and the vibration plate 310 of the corresponding discharge section D is warped in the +Z direction as a result. As a result of this, in comparison with the state of Phase-1, in the manner of the state of Phase-2 shown in FIG. 5, the volume of the cavity 320 of the corresponding discharge section D expands. Next, for example, in a state of Phase-2, distortion that displaces the corresponding piezoelectric element 300 in the −Z direction, is generated as a result of the driving signal creation section 51 changing the potential of the driving signal Vin, and the vibration plate 310 of the corresponding discharge section D is warped in the −Z direction as a result. As a result of this, in the manner of the state of Phase-3 shown in FIG. 5, the volume of the cavity 320 rapidly contracts. At this time, a portion of the ink, with which the cavity 320 is filled, is discharged as ink droplets from the nozzle N, which is in communication with the cavity 320 as a result of a compression pressure, which is generated inside the cavity 320.

The discharge section D, which includes the vibration plate 310, vibrates after being displaced in the Z axis direction due to the piezoelectric element 300 and the vibration plate 310 being driven by the driving signal Vin. Hereinafter, the vibrations that are generated in the discharge section D as a result of driving of the discharge section D by the driving signal Vin, will be referred to as residual vibrations. It is assumed that the residual vibrations, which are generated in the discharge section D include a natural vibration frequency, which is determined by an acoustic resistance Res due to the shapes of the nozzle N and the ink supply opening 360, or the viscosity of the ink, or the like, an inertance Int due to a weight of ink inside flow channels, and a compliance Cm of the vibration plate 310. Hereinafter, a calculation model of the residual vibrations of the discharge section D will be described based on the corresponding assumption.

Figure 6:
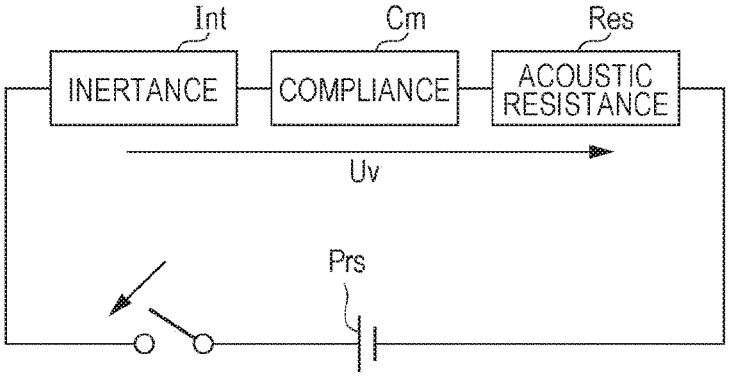
FIG. 6 is a circuit diagram that shows a simple harmonic motion model, which represents residual vibrations in the discharge section.

FIG. 6 is a circuit diagram that shows a simple harmonic motion model, in which residual vibrations of the vibration plate 310 are assumed. As shown in the drawing, the calculation model of the residual vibrations of the vibration plate 310 can be represented by an acoustic pressure Prs, and the abovementioned inertance Int, compliance Cm, and acoustic resistance Res. Further, if a step response when the acoustic pressure Prs is applied to the circuit of FIG. 6, is calculated for a volume velocity Uv, the following equation is obtained.

$$Uv=\{Prs/(\omega\cdot Int)\}e^{-\gamma t}\cdot\sin(\omega t)$$

$$\omega=\{1/(Int\cdot Cm)-\gamma^2\}^{1/2}$$

$$\gamma=\mathrm{Res}/(2\cdot Int)$$

Hereinafter, a calculated value that is obtained from the equation, and an experimental result (an experiment value) in an experiment of the residual vibrations of the discharge section D which is performed separately, are compared.

Figure 7:
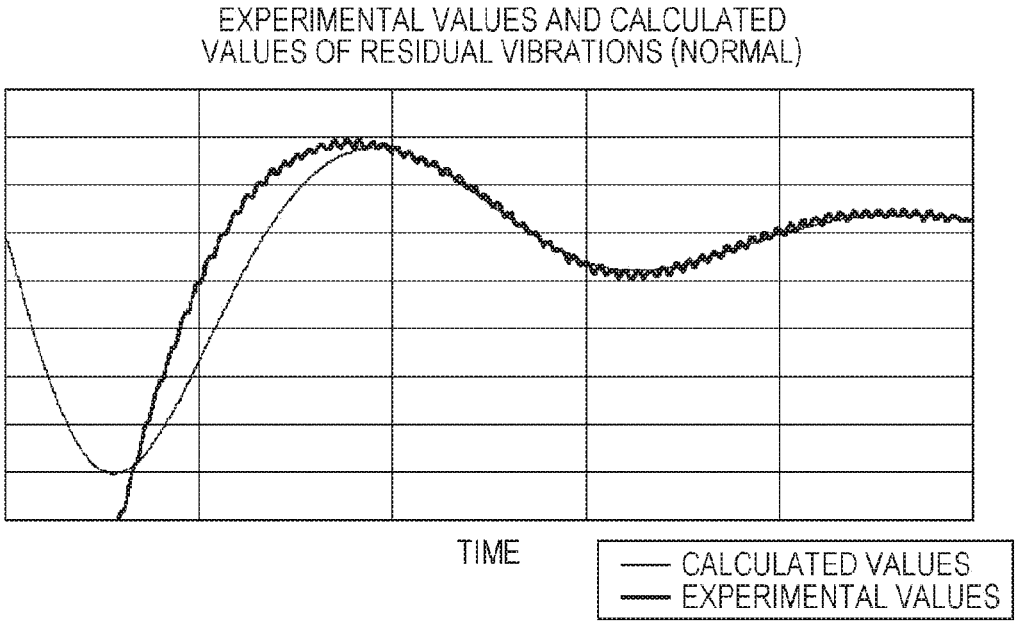
FIG. 7 is a graph that shows a relationship between experimental values and calculated values of residual vibrations in the discharge section.

FIG. 7 is a graph that shows a relationship between experimental values and calculated values of the residual vibrations. Additionally, the experimental values that are shown in FIG. 7 are values that are obtained using an experiment that detects the residual vibrations that are generated in the vibration plate 310 of a discharge section D, in which the discharge state of the ink is normal, after ink is discharged from the corresponding discharge section D. As shown in FIG. 7, in a case in which the discharge state of the ink in the discharge section D is normal, two waveforms of the experimental values and the calculated values generally coincide.

Meanwhile, irrespective of whether or not the discharge section D performed an ink discharge action, there are cases in which the discharge state of the ink in the corresponding discharge section D is abnormal, and ink droplets are not normally discharged from the nozzle N of the corresponding discharge section D, that is, there are cases in which there is a discharge abnormality. Examples of possible causes of a discharge abnormality include (1) the incorporation of an air bubble inside the cavity 320, (2) thickening or fixing of the ink inside the cavity 320 caused by drying of the ink inside the cavity 320, (3) the attachment of foreign matter such as paper dust to the vicinity of an outlet of the nozzle N, and the like.

Hereinafter, on the basis of the comparison results that are shown in FIG. 7, at least either one of the acoustic resistance Res and the inertance Int will be adjusted for each cause of a discharge abnormality that occurs in the discharge section D so that the calculated values and the experiment values of the residual vibrations generally coincide.

Figure 8:
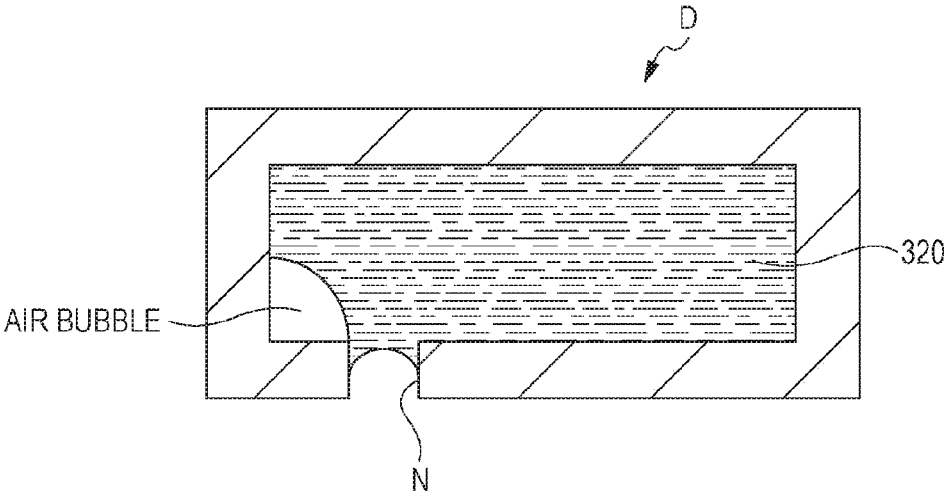
FIG. 8 is an explanatory diagram that describes a case in which an air bubble is incorporated inside the discharge section.
Figure 9:
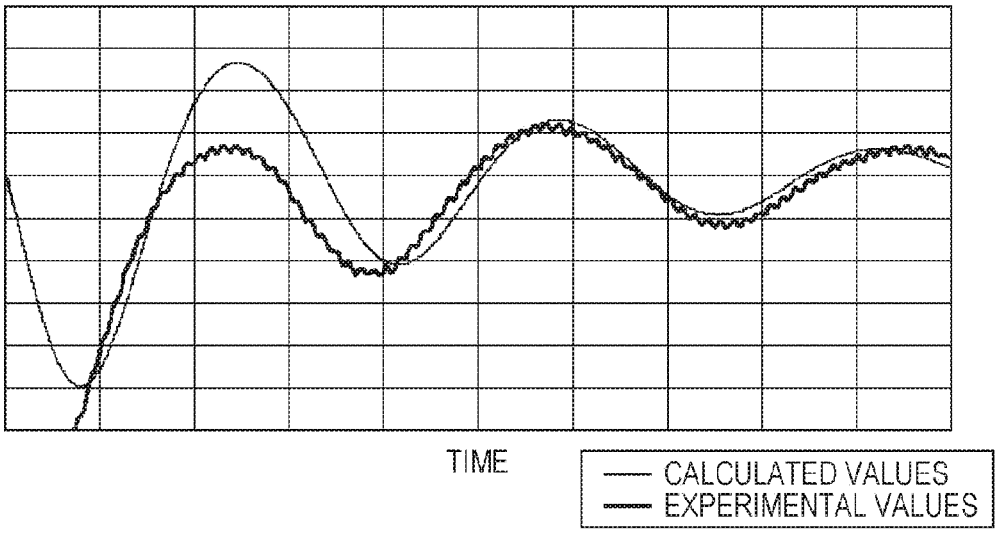
FIG. 9 is a graph that shows experimental values and calculated values of residual vibrations in the discharge section.

FIG. 8 is a conceptual drawing for, among the discharge abnormalities, describing (1) the incorporation of an air bubble inside the cavity 320. As shown in FIG. 8, in a case in which an air bubble is incorporated inside the cavity 320, a total weight of ink inside the cavity 320 is reduced, and therefore, it is thought that the inertance Int decreases. In addition, in a case in which an air bubble is attached to the vicinity of the of the nozzle N, a state in which it is supposed that the diameter of the nozzle N is increased by an amount that is equivalent to the diameter of the air bubble, is attained, and therefore, it is thought that the acoustic resistance Res decreases. In such an instance, a graph such as that of FIG. 9 is obtained by setting the acoustic resistance Res and the inertance Int to be smaller than the case shown in FIG. 7, and matching with experiment values of the residual vibrations when an air bubble is incorporated. As shown in FIGS. 7 and 9, in a case in which an air bubble is incorporated inside the cavity 320 and a discharge abnormality occurs, the frequency of the residual vibrations is higher than a case in which the discharge state is normal.

Figure 10:
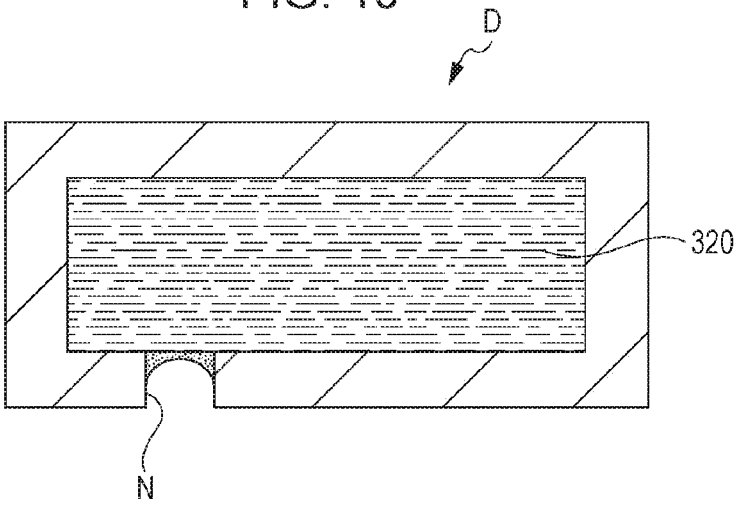
FIG. 10 is an explanatory drawing that describes a case in which ink is fixed to the inside of the discharge section.
Figure 11:
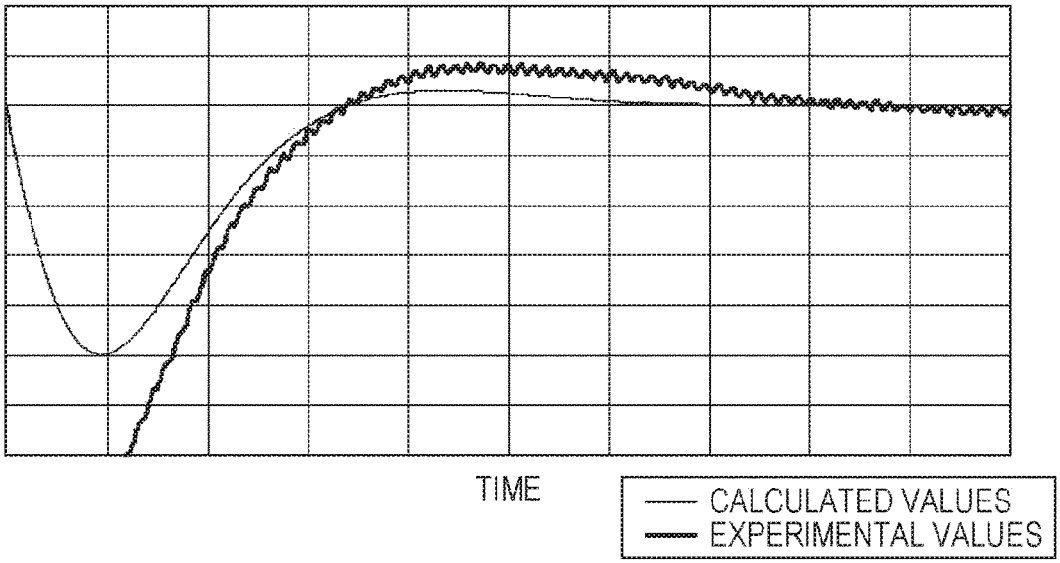
FIG. 11 is a graph that shows experimental values and calculated values of residual vibrations in the discharge section.

FIG. 10 is a conceptual drawing for, among the discharge abnormalities, describing (2) thickening or fixing of the ink inside the cavity 320. As shown in FIG. 10, in a case in which the ink in the vicinity of the nozzle N becomes fixed due to drying, a circumstance in which the ink inside the cavity 320 is confined inside the cavity 320, is attained. In such a case, it is thought that the acoustic resistance Res increases. In such an instance, a graph such as that of FIG. 11 is obtained by setting the acoustic resistance Res to be larger than the case shown in FIG. 7, and matching with experiment values of the residual vibrations in a case in which the ink in the vicinity of the nozzle N becomes fixed or thickens. Additionally, the experiment values that are shown in FIG. 11 are values for which the residual vibrations of the vibration plate 310, which a discharge section D is provided with, are measured in a state in which the corresponding discharge section D is left in a state in which a cap (not illustrated in the drawings) is not installed, and the ink in the vicinity of the nozzle N becomes fixed. As shown in FIGS. 7 and 11, in a case in which the ink in the vicinity of the nozzle N becomes fixed inside the cavity 320, in comparison with a case in which the discharge state is normal, the frequency of the residual vibrations is reduced, and a characteristic waveform, in which the residual vibrations are overdampened, is obtained.

Figure 12:
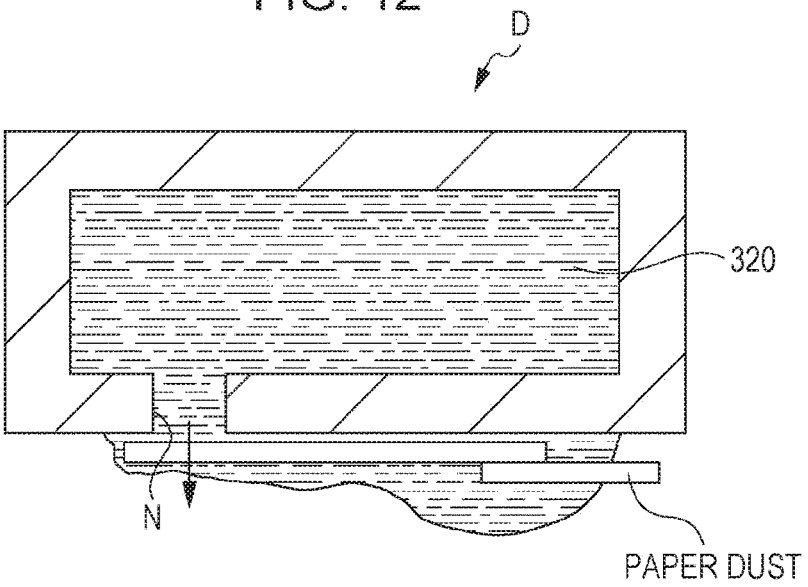
FIG. 12 is an explanatory drawing that describes a case in which foreign matter is attached to the discharge section.
Figure 13:
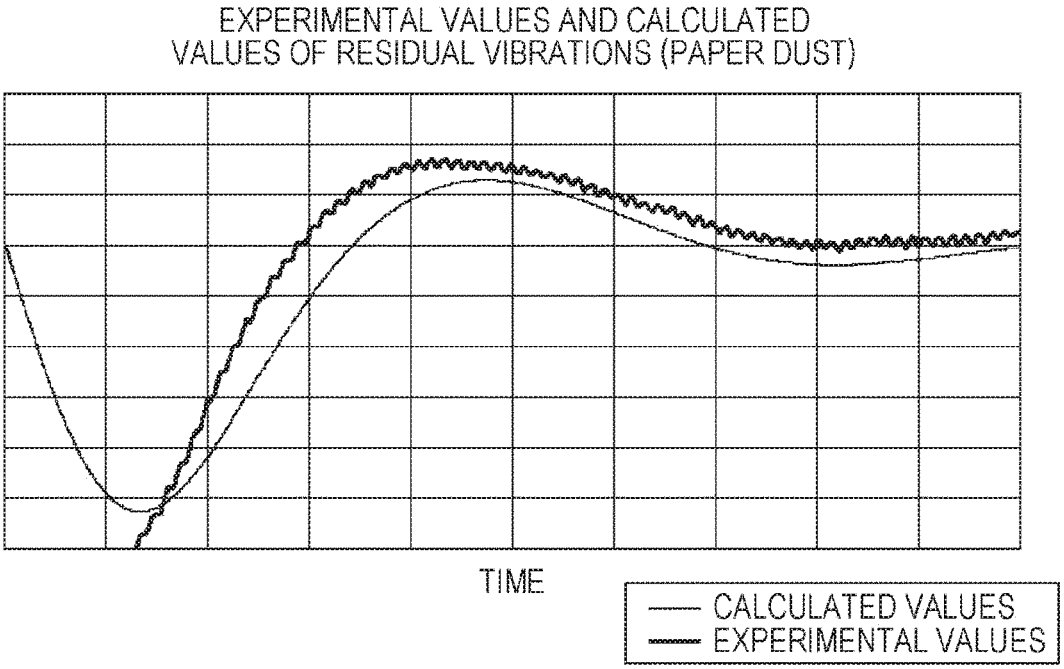
FIG. 13 is a graph that shows experimental values and calculated values of residual vibrations in the discharge section.

FIG. 12 is a conceptual drawing for, among the discharge abnormalities, describing (3) the attachment of foreign matter such as paper dust to the vicinity of the outlet of the nozzle N. As shown in FIG. 12, in a case in which foreign matter becomes adhered to the vicinity of the outlet of the nozzle N, the ink seeps out from inside the cavity 320 through the foreign matter, and it is no longer possible to discharge the ink from the nozzle N. In a case in which ink is seeping out from the nozzle N, it is supposed that in comparison with a case in which ink is not seeping out, a weight of the ink with which the inside of the cavity 320 is filled, is increased by an amount that is equivalent to a weight that corresponds to ink that has seeped out. In other words, in a case in which ink is seeping out from the nozzle N, it is thought that the inertance Int increases. In addition, it is though that the acoustic resistance Res also increases as a result of the foreign matter that is attached to the vicinity of the outlet of the nozzle N. In such an instance, a graph such as that of FIG. 13 is obtained by setting the inertance Int and the acoustic resistance Res to be larger than the case that is shown in FIG. 7, and matching with experiment values of the residual vibrations when foreign matter is attached to the vicinity of the outlet of the nozzle N. As can be understood from FIGS. 7 and 13, in a case in which paper dust is attached to the vicinity of the outlet of the nozzle N, the frequency of the residual vibrations is lower than a case in which the discharge state is normal.

Additionally, from FIGS. 11 and 13, it can be understood that the frequency of the residual vibrations is higher in the case of (3) the attachment of foreign matter to the vicinity of the outlet of the nozzle N than in the case of (2) the thickening of the ink inside the cavity 320.

As is evident from the abovementioned explanation, it is possible to determine the discharge state of the ink in the discharge section D on the basis of the waveform of the residual vibrations, which are generated when the discharge section D is driven, and in particular, the frequency or the period length of the residual vibrations. More specifically, by comparing the frequency or period length of the residual vibrations with threshold values established in advance, it is possible to determine whether or not the discharge state in the discharge section D is normal, and, in a case in which the discharge state in the discharge section D is abnormal, to determine which of the abovementioned (1) to (3) the cause of a corresponding discharge abnormality corresponds to. The ink jet printer 1 of the present embodiment executes a discharge state determination process, which determines the discharge state by analyzing residual vibrations.

4. Configurations and Actions of Head Driver and Determination Unit

Next, the head driver 5 (the driving signal creation section 51, the connection section 53 and the detection unit 8) and the determination unit 4 will be described with reference to FIGS. 14 to 18.

4.1. Driving Signal Creation Section

Figure 14:
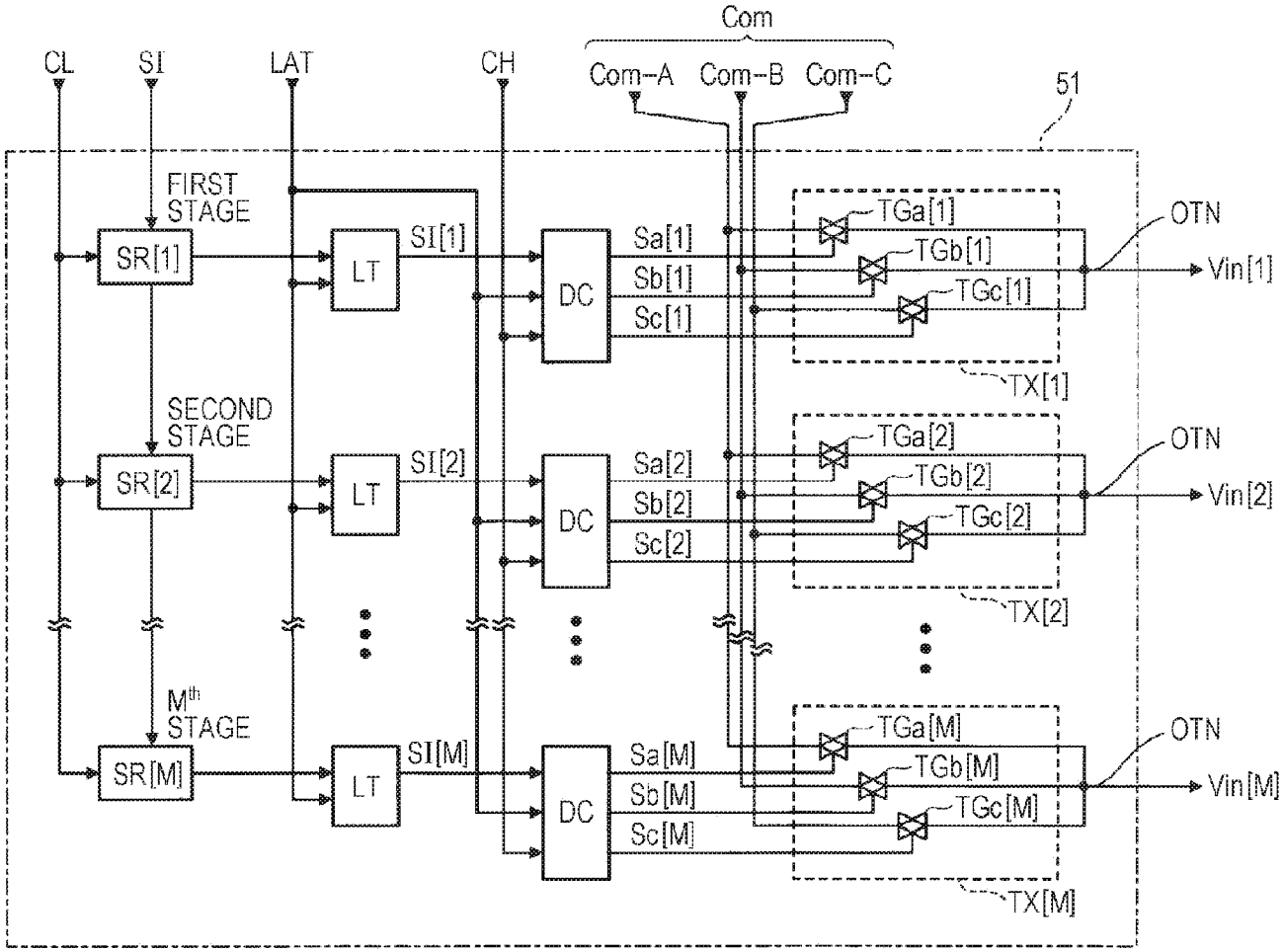
FIG. 14 is a block diagram that shows a configuration of a driving signal creation section.

FIG. 14 is a block diagram that shows a configuration of the driving signal creation section 51 in the head driver 5. As shown in FIG. 14, the driving signal creation section 51 includes M stages in which sets, which are formed from a shift register SR, a latch circuit LT, a decoder DC, and a switching section TX, correspond to the M discharge sections D on a one-to-one basis.

As shown in FIG. 14, the clock signal CL, the printing signal SI, a latch signal LAT, a change signal CH, and the driving waveform signals Com are supplied to the driving signal creation section 51 from the control section 6.

The driving waveform signal Com is a signal that includes a plurality of waveforms for driving the discharge sections D, and in the abovementioned manner, includes the driving waveform signals Com-A, Com-B and Com-C.

The printing signal SI is a signal that designates a driving waveform signal Com that should be supplied to each discharge section D. The printing signal SI includes printing signals SI[1] to SI[M]. In the present embodiment, a printing signal SI[m] designates either one of a portion of or all of the presence or absence of the execution of the determination of the discharge state in a discharge section D[m], the presence or absence of the discharge of ink from a discharge section D[m], and the amount of ink that a discharge section D[m] should discharge by designating a waveform of the driving waveform signal Com that should be supplied to a discharge section D[m].

More specifically, firstly, a printing signal SI[m] designates whether or not a discharge section D[m] corresponds to a target discharge section Dtg. In other words, a printing signal SI[m] designates whether or not a discharge section D[m] corresponds to a target for the determination of discharge state in the discharge state determination process.

In addition, in a case in which a discharge section D[m] is not designated as a target discharge section Dtg, a printing signal SI[m] designates either one of the discharge of an amount of ink that corresponds to a large dot, the discharge of an amount of ink that corresponds to a medium dot, the discharge of an amount of ink that corresponds to a small dot, or non-discharge of ink to the discharge section D[m] (refer to FIG. 15).

The control section 6 creates the printing signal SI on the basis of the printing data Img in a case in which the ink jet printer 1 is executing a printing process. More specifically, firstly, the control section 6 determines an amount of ink that each discharge section D should discharge in order to form images that the printing data Img shows. Next, for each discharge section D[m] that should discharge ink in order to form images that the printing data Img shows, the control section 6 creates a printing signal SI[m] that designates the amount of ink that the corresponding discharge section D[m] should discharge. In addition, the control section 6 selects a target discharge section Dtg from among one or a plurality of discharge sections D that should not discharge ink in order to form images that the printing data Img shows. Further, among the discharge sections D that should not discharge ink, the control section 6 creates a printing signal SI[m], which designates that a corresponding discharge section D[m] is a target of the determination the discharge state, for the discharge section D[m] selected as a target discharge section Dtg. In addition, among the discharge sections D that should not discharge ink, the control section 6 creates printing signals SI[m], which designate that corresponding discharge sections D[m] do not discharge ink, for the discharge sections D[m] that are not selected as a target discharge section Dtg.

Meanwhile, the control section 6 creates the printing signal SI without being based on the printing data Img in a case in which the ink jet printer 1 is not executing a printing process. More specifically, firstly, the control section 6 selects a target discharge section Dtg from among the M discharge sections D that the ink jet printer 1 is provided with. Next, the control section 6 creates a printing signal SI[m], which designates that a corresponding discharge section D[m] is the target of the determination the discharge state, for the discharge section D[m] selected as a target discharge section Dtg. In addition, the control section 6 creates printing signals SI[m], which designate that the corresponding discharge sections D[m] do not discharge ink, for the discharge sections D[m] that are not selected as a target discharge section Dtg.

Given that, action periods, which are periods in which the ink jet printer 1 executes various processes such as the printing process and the discharge state determination process, are configured from a plurality of unit periods Tu.

Further, the control section 6 repeatedly executes the above-mentioned creation of the printing signal SI (the printing signals SI[1] to SI[M]) every unit period Tu. As a result of this, for example, the control section 6 can select M target discharge sections Dtg in M unit periods Tu. In other words, for example, the control section 6 can execute the discharge state determination process with all of the M discharge sections D[1] to D[M] set as targets in M unit periods Tu.

In addition, in a case in which the ink jet printer 1 is executing a printing process, the control section 6 executes control that performs driving in a manner that executes either one of the discharge of an amount of ink that corresponds to a large dot, the discharge of an amount of ink that corresponds to a medium dot, the discharge of an amount of ink that corresponds to a small dot, or non-discharge of ink in discharge sections D other than a target discharge section Dtg in each unit period Tu.

Additionally, in the present embodiment, a case in which the printing signal SI[m] is a 3-bit digital signal that is formed from bits b1, b2 and b3 is assumed.

More specifically, hereinafter, a case in which the bits (b1, b2 and b3) that a printing signal SI[m] includes show (1, 1, 0) in a case of designating the discharge of an amount of ink that corresponds to a large dot in a discharge section D[m], show (1, 0, 0) in a case of designating the discharge of an amount of ink that corresponds to a medium dot in a discharge section D[m], show (0, 1, 0) in a case of designating the discharge of an amount of ink that corresponds to a small dot in a discharge section D[m], show (0, 0, 0) in a case of designating non-discharge of ink in a discharge section D[m], and show (0, 0, 1) in a case of designating a target of the determination of the discharge state in a discharge section D[m], is assumed (refer to FIG. 15).

The driving signal creation section 51 supplies a driving signal Vin, which includes a waveform that a printing signal SI[m] designates from among the plurality of waveforms that the driving waveform signal Com includes, to a discharge section D[m]. Additionally, in the abovementioned manner, among a driving signal Vin, a signal that is supplied to discharge section D[m] is referred to as a driving signal Vin[m].

The shift registers SR temporarily maintain the printing signals SI[1] to SI[M], which are supplied in serial, for each three bits that correspond to each discharge section D. More specifically, the shift registers SR have a configuration in which M shift registers SR of the first stage, the second stage, . . . , and an $M^{th}$ stage, which correspond to the M discharge sections D on a one-to-one basis, are cascade connected with one another, and sequentially transmit the supplied printing signal SI to later stages in accordance with the clock signal CL. Further, when the printing signal SI is transmitted by all of the M shift registers SR, a state in which each of the M shift registers SR maintains three bits of data among the printing signal SI that correspond to itself, is retained. Hereinafter, there are cases in which a shift register SR of an $m^{th}$ stage is referred to as a shift register SR[m].

M latch circuits LT respectively latch the 3-bit printing signals SI[m], which are respectively maintained by the M shift registers SR, and correspond to each stage, in a concurrent manner at a timing at which the latch signal LAT rises. That is, the latch circuit LT of an $m^{th}$ stage latches the printing signal SI[m], which is maintained by the shift register SR[m].

The control section 6 supplies the printing signal SI and the driving waveform signal Com to the driving signal creation section 51 every unit period Tu, and supplies the latch signal LAT in a manner in which the latch circuits LT latch a printing signal SI[m] every unit period Tu. As a result of this, in each unit period Tu, the control section 6 controls the driving signal creation section 51 in a manner that supplies a driving signal Vin[m] to a discharge section D[m].

Additionally, in the present embodiment, the control section 6 divides the unit periods Tu into a control period Ts1 and a control period Ts2 using the change signal CH. In the present embodiment, the control periods Ts1 and Ts2 include mutually equivalent durations. Hereinafter, there are cases in which the control periods Ts1 and Ts2 are collectively referred to as a control period Ts.

A decoder DC decodes a printing signals SI[m] that is latched by a latch circuits LT, and outputs selection signals Sa[m], Sb[m] and Sc[m].

FIG. 15 is an explanatory drawing that shows decoding contents of a decoder DC in each unit period Tu. As shown in the drawing, a decoder DC of an $m^{th}$ stage outputs selection signals Sa[m], Sb[m] and Sc[m] of levels that depend on values that the bits b1, b2 and b3, which a printing signal SI[m] includes, show, in the respective control periods Ts1 and Ts2 of each unit period Tu. In the present embodiment, among selection signals Sa[m], Sb[m] and Sc[m], a decoder DC of an $m^{th}$ stage sets one signal to an H level, and sets the other two signals to an L level in the respective control periods Ts1 and Ts2 of each unit period Tu. For example, in a case in which a printing signal SI[m] that is supplied in a unit period Tu is (b1, b2, b3)=(1, 0, 0), a decoder DC of an $m^{th}$ stage respectively sets a selection signal Sa[m] to a high level H, a selection signal Sb[m] to a low level L, and a selection signal Sc[m] to a low level L in the control period Ts1, and respectively sets the selection signal Sa[m] to a low level L, the selection signal Sb[m] to a high level H, and the selection signal Sc[m] to a low level L in the control period Ts2.

As shown in FIG. 14, the driving signal creation section 51 is provided with M switching sections TX in a manner that corresponds to the M discharge sections D on a one-to-one basis. A switching section TX[m] of an $m^{th}$ stage is provided with a transmission gate TGa[m], which is turned on in a control period Ts in which a selection signal Sa[m] reaches an H level, and is turned off in a control period Ts in which the selection signal Sa[m] reaches an L level, a transmission gate TGb[m], which is turned on in a control period Ts in which a selection signal Sb[m] reaches an H level, and is turned off in a control period Ts in which the selection signal Sb[m] reaches an L level, a transmission gate TGc[m], which is turned on in a control period Ts in which a selection signal Sc[m] reaches an H level, and is turned off in a control period Ts in which the selection signal Sc[m] reaches an L level.

As shown in FIG. 14, the driving waveform signal Com-A is supplied to an end of a transmission gate TGa[m], the driving waveform signal Com-B is supplied to an end of a transmission gate TGb[m] and the driving waveform signal Com-C is supplied to an end of a transmission gate TGc[m]. In addition, the other ends of the transmission gates TGa[m], TGb[m] and TGc[m] are electrically connected to an output end OTN of an $m^{th}$ stage. That is, a switching section TX[m] selects a single signal from among the driving waveform signals Com-A, Com-B and Com-C in each control period Ts, and supplies the selected signal to a discharge section D[m] as a driving signal Vin[m] via an output end OTN of an $m^{th}$ stage. More specifically, in each control period Ts, a switching section TX[m] selects and supplies the driving waveform signal Com-A to a discharge section D[m] if a selection signal Sa[m] is an H level, selects and supplies the driving waveform signal Com-B to a discharge section D[m] if a selection signal Sb[m] is an H level, and selects and supplies the driving waveform signal Com-C to a discharge section D[m] if a selection signal Sc[m] is an H level.

Figure 16:
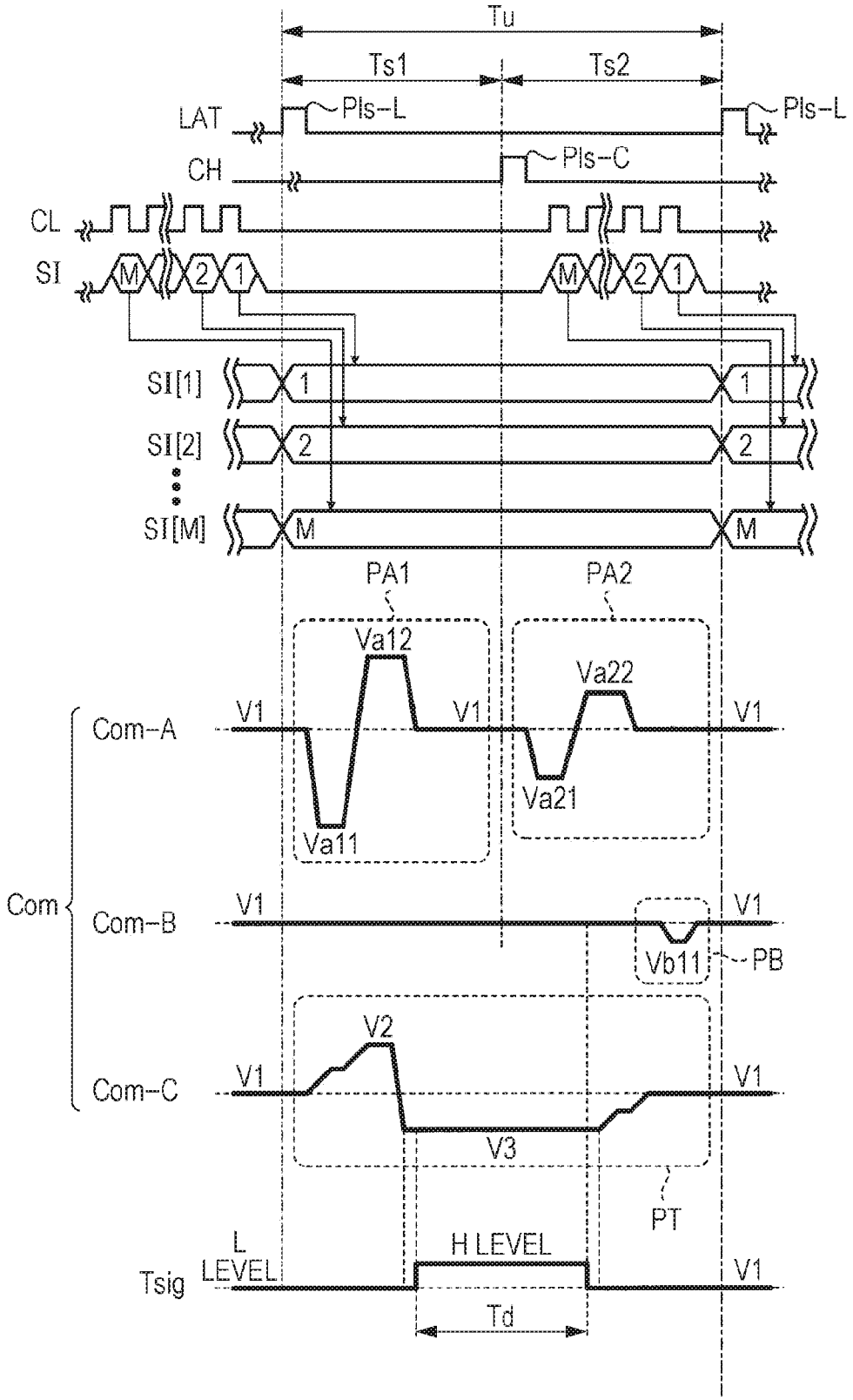
FIG. 16 is a timing chart that shows a waveform of a driving waveform signal.

FIG. 16 is a timing chart for describing signals, such as the driving waveform signal Com, that the control section 6 supplies to the driving signal creation section 51 in each unit period Tu.

As shown in FIG. 16, unit periods Tu are divided by a pulse Pls-L, which is included in the latch signal LAT, and in addition, the control periods Ts1 and Ts2 are divided by a pulse Pls-C, which is included in the change signal CH.

The control section 6 supplies the printing signals SI[1] to SI[M] to the driving signal creation section 51 in synchronization with the clock signal CL prior to the initiation of each unit period Tu. Further, the shift registers SR of the driving signal creation section 51 sequentially transmit the supplied printing signals SI[m] to later stages in accordance with the clock signal CL.

As is illustrated in FIG. 16 by way of example, the driving waveform signal Com-A, which the control section 6 outputs in each unit period Tu, includes a discharge waveform PA1 (hereinafter, referred to as a "waveform PA1"), which is provided in the control period Ts1, and a discharge waveform PA2 (hereinafter, referred to as a "waveform PA2"), which is provided in the control period Ts2.

The waveform PA1 is a waveform according to which a medium amount of the ink, which corresponds to a medium dot, is discharged from a discharge section D[m] when a driving signal Vin[m] that includes the waveform PA1, is supplied to the discharge section D[m].

The waveform PA2 is a waveform according to which a small amount of the ink, which corresponds to a small dot, is discharged from a discharge section D[m] when a driving signal Vin[m] that includes the waveform PA2, is supplied to the discharge section D[m].

For example, a difference in potential between the lowest potential (a potential Va11 in this example) and the highest potential (a potential Va12 in this example) of the waveform PA1 is greater than a difference in potential between the lowest potential (a potential Va21 in this example) and the highest potential (a potential Va22 in this example) of the waveform PA2.

Additionally, the waveforms PA1 and PA2 are established so as to be equivalent to a reference potential V1 (an example of a "first potential". Hereinafter, referred to as a "potential V1") at the start and at the end of the control periods Ts1 and Ts2.

As is illustrated in FIG. 16 by way of example, the driving waveform signal Com-B, which the control section 6 outputs in each unit period Tu, includes a micro vibration waveform PB (hereinafter, referred to as a "waveform PB"), which is provided in the control period Ts2.

The waveform PB is a waveform according to which the ink is not discharged from a discharge section D[m] in a case in which a driving signal Vin[m] that includes the waveform PB is supplied to the discharge section D[m]. In other words, the waveform PB is a waveform for preventing thickening of the ink by applying micro vibrations to the ink inside the discharge sections D. For example, a difference in potential between the lowest potential (a potential Vb11 in this example) and the highest potential (the potential V1 in this example) of the waveform PB is established so as to be smaller than a difference in potential between the lowest potential and the highest potential of the waveform PA2.

Additionally, the waveforms PA1 and PA2 are established so as to be equivalent to the potential V1 at the start and at the end of the control periods Ts1 and Ts2.

As is illustrated in FIG. 16 by way of example, the driving waveform signal Com-C, which the control section 6 outputs in each unit period Tu, includes an inspection waveform PT (hereinafter, referred to as a "waveform PT"), which is provided in the control periods Ts1 and Ts2.

The waveform PT is a waveform according to which the ink is not discharged from a discharge section D[m] in a case in which a driving signal Vin[m] that includes the waveform PT is supplied to the discharge section D[m]. In other words, it is assumed that the discharge state determination process according to the present embodiment is a case of so-called "non-discharge detection", which determines the discharge state of the ink in the discharge sections D on the basis of the residual vibrations that are generated in the discharge sections D when the corresponding discharge sections D are driven in a manner that does not discharge the ink.

More specifically, as shown in FIG. 16, the waveform PT is a waveform that changes from the potential V1→a potential V2 (an example of a "second potential")→a potential V3 (an example of a "third potential")→the potential V1 in a unit period Tu. In the present embodiment, a case in which the potential V2 is a higher potential than the potential V1, and the potential V1 is a higher potential than the potential V3, is assumed. Further, in the present embodiment, a case in which a difference in potential between the potential V2 and the potential V1 is greater than a difference in potential between the potential V1 and the potential V3, is assumed. Furthermore, in the present embodiment, a case in which a difference in potential between the potential V3 and the potential V2 is greater than a difference in potential between the lowest potential and the highest potential of the waveform PA2, is assumed. In addition, in the waveform PT according to the present embodiment, a case in which a change in potential from the potential V1 to the potential V2 and a change in potential from the potential V3 to the potential V1 are more gradual (change over a longer period) than a change in potential from the potential Va21 to the potential Va22 in the waveform PA2, is assumed. Additionally, the details of the waveform PT will be described later.

Additionally, as is illustrated by way of example in FIG. 16, the control section 6 outputs a detection period designation signal Tsig, which reaches an H level in a detection period Td, to the head driver 5. Although described in more detail later, the detection period Td is a period of a portion in a period in which the potential of the driving waveform signal Com-C, which includes the waveform PT, is set to the potential V3. In the present embodiment, a case in which the waveform PB is provided after the end of the detection period Td in the unit period Tu.

Figure 17:
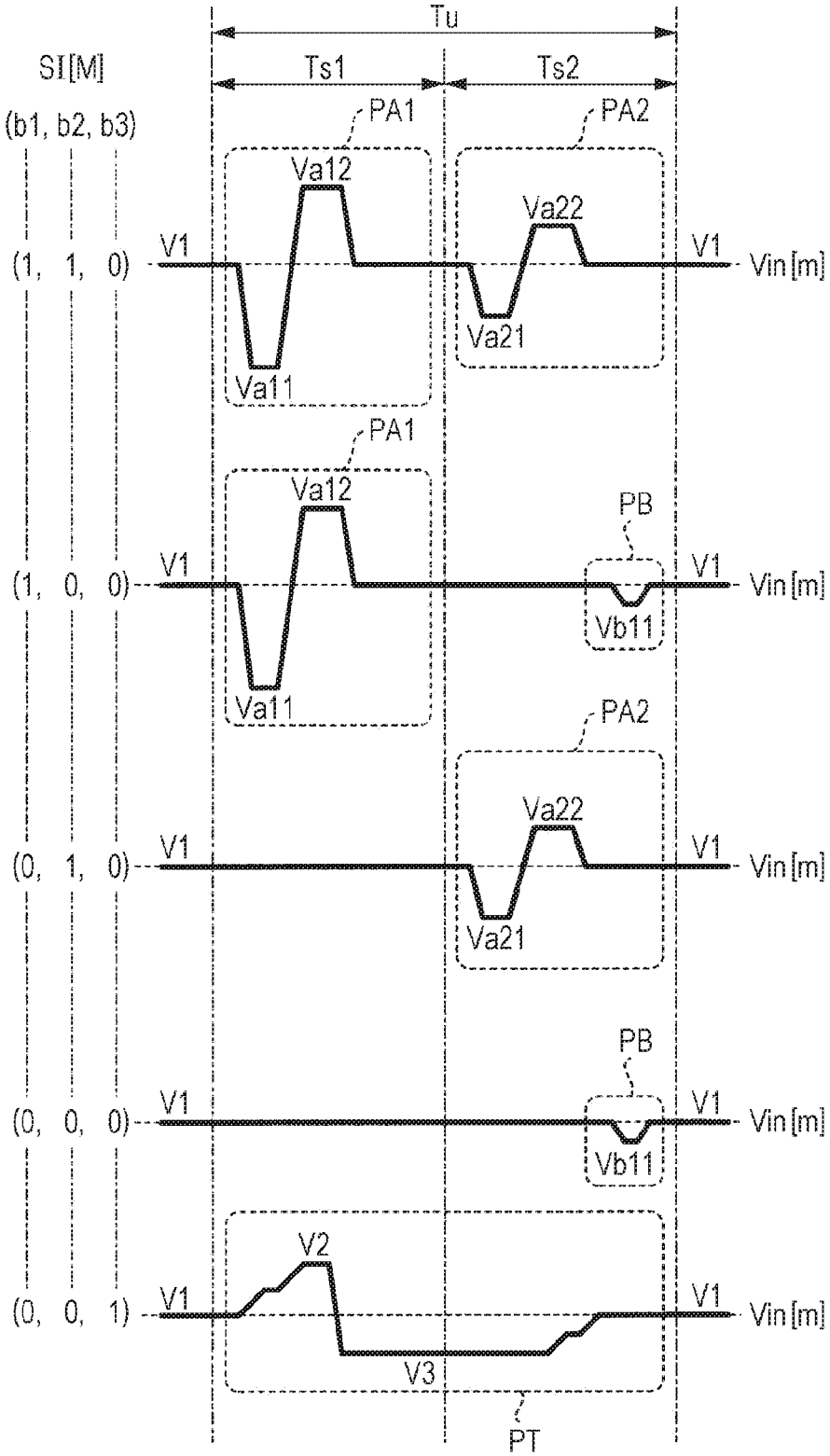
FIG. 17 is a timing chart that shows a waveform of the driving signal.

Next, the driving signal Vin that the driving signal creation section 51 outputs in a unit period Tu will be described with reference to FIG. 17 in addition to FIGS. 14 to 16.

In a case in which a printing signal SI[m] that is supplied in a unit period Tu shows (1, 1, 0), as shown in FIG. 15, a selection signal Sa[m] reaches an H level in the control periods Ts1 and Ts2. In this case, a switching section TX[m] outputs a driving signal Vin[m] that includes the waveform PA1 by selecting the driving waveform signal Com-A in the control period Ts1, and outputs a driving signal Vin[m] that includes the waveform PA2 by selecting the driving waveform signal Com-A in the control period Ts2. Accordingly, in this case, as shown in FIG. 17, a driving signal Vin[m], which is supplied to a discharge section D[m] in a unit period Tu includes the waveform PA1 and the waveform PA2. As a result of this, the discharge section D[m] discharges a medium amount of ink based on the waveform PA1, and a small amount of ink based on the waveform PA2 in the corresponding unit period Tu, and forms a large dot on a recording sheet P as a result of the ink that is discharged during the above-mentioned two times.

In a case in which a printing signal SI[m] that is supplied in a unit period Tu shows (1, 0, 0), as shown in FIG. 15, a selection signal Sa[m] reaches an H level in the control period Ts1 and a selection signal Sb[m] reaches an H level in the control period Ts2. In this case, a switching section TX[m] outputs a driving signal Vin[m] that includes the waveform PA1 by selecting the driving waveform signal Com-A in the control period Ts1, and outputs a driving signal Vin[m] that includes the waveform PB by selecting the driving waveform signal Com-B in the control period Ts2. Accordingly, in this case, as shown in FIG. 17, a driving signal Vin[m], which is supplied to a discharge section D[m] in a unit period Tu includes the waveform PA1 and the waveform PB. As a result of this, the discharge section D[m] discharges a medium amount of the ink on the basis of the waveform PA1 in the corresponding unit period Tu, and forms a medium dot on a recording sheet P.

In a case in which a printing signal SI[m] that is supplied in a unit period Tu shows (0, 1, 0), as shown in FIG. 15, a selection signal Sb[m] reaches an H level in the control period Ts1 and a selection signal Sa[m] reaches an H level in the control period Ts2. In this case, a switching section TX[m] outputs a driving signal Vin[m] that is set to the potential V1 by selecting the driving waveform signal Com-B in the control period Ts1, and outputs a driving signal Vin[m] that includes the waveform PA2 by selecting the driving waveform signal Com-A in the control period Ts2. Accordingly, in this case, as shown in FIG. 17, the driving signal Vin[m], which is supplied to a discharge section D[m] in the unit period Tu, includes the waveform PA2. As a result of this, the discharge section D[m] discharges a small amount of the ink based on the waveform PA2 in the corresponding unit period Tu, and forms a small dot on a recording sheet P.

In a case in which a printing signal SI[m] that is supplied in a unit period Tu shows (0, 0, 0), as shown in FIG. 15, a selection signal Sb[m] reaches an H level in the control periods Ts1 and Ts2. In this case, a switching section TX[m] outputs a driving signal Vin[m] that is set to the potential V1 by selecting the driving waveform signal Com-B in the control period Ts1, and outputs a driving signal Vin[m] that includes the waveform PB by selecting the driving waveform signal Com-B in the control period Ts2. Accordingly, in this case, as shown in FIG. 17, the driving signal Vin[m], which is supplied to a discharge section D[m] in the unit period Tu, includes the waveform PB. As a result of this, the discharge section D[m] does not discharge the ink in the corresponding unit period Tu, and a dots is not formed on a recording sheet P (corresponds to non-recording).

In a case in which a printing signal SI[m] that is supplied in a unit period Tu shows (0, 0, 1), as shown in FIG. 15, a selection signal Sc[m] reaches an H level in the control periods Ts1 and Ts2. In this case, a switching section TX[m] outputs a driving signal Vin[m] that is set to the waveform PT by selecting the driving waveform signal Com-C in the control periods Ts1 and Ts2. Accordingly, in this case, as shown in FIG. 17, the driving signal Vin[m], which is supplied to a discharge section D[m] in the unit period Tu, includes the waveform PT.

In a case in which a discharge section D[m] is set as a target of the discharge state determination process in a single unit period Tu, or in other words, in a case in which the discharge section D[m] is designated as a target discharge section Dtg in a single unit period Tu, the control section 6 sets a value of a printing signal SI[m] to (0, 0, 1) so that a driving signal Vin[m], which includes the waveform PT, is supplied to the discharge section D[m] in the corresponding single unit period Tu.

4.2. Connection Section

Figure 18:
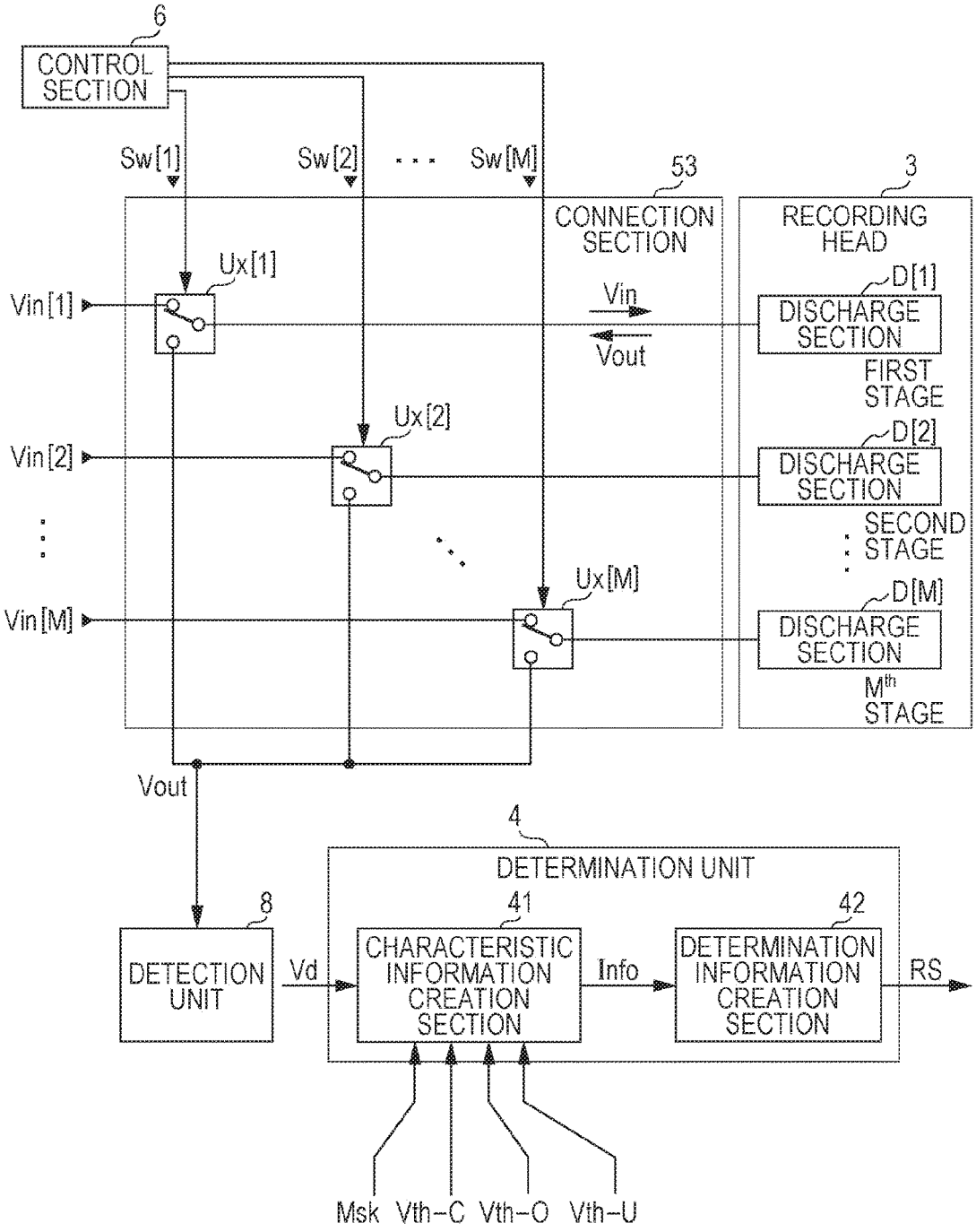
FIG. 18 is a block diagram that shows configurations of a connection section and a determination unit.

FIG. 18 is a block diagram that shows examples of configurations of the connection section 53 and the determination unit 4.

As is illustrated by way of example in FIG. 18, the connection section 53 is provided with M connection circuits Ux (Ux[1], Ux[2], . . . , and Ux[M]) of the first stage to an $M^{th}$ stage, which correspond to the M discharge sections D on a one-to-one basis. A connection circuit Ux[m] of an $m^{th}$ stage electrically connects the upper section electrode 302 of the piezoelectric element 300 of a discharge section D[m] to either one of the output end OTN of an $m^{th}$ stage, which the driving signal creation section 51 is provided with, or the detection unit 8. Hereinafter, a state in which a connection circuit Ux[m] electrically connects a discharge section D[m] and the output end OTN of an $m^{th}$ stage of the driving signal creation section 51 will be referred to as a first connection state. In addition, a state in which a connection circuit Ux[m] electrically connects a discharge section D[m] and the detection unit 8 will be referred to as a second connection state.

In a case in which the control section 6 designates a discharge section D[m] as a target discharge section Dtg in a single unit period Tu, a connection circuit Ux[m] electrically connects a discharge section D[m] and the detection unit 8 as a result of reaching the second connection state in the detection period Td (refer to FIG. 16) in the single unit period Tu. In addition, in a case in which the control section 6 designates a discharge section D[m] as a target discharge section Dtg in a unit period Tu, a connection circuit Ux[m] electrically connects a discharge section D[m] and the driving signal creation section 51 as a result of reaching the first connection state in periods of the single unit period Tu other than in the detection period Td. On the other hand, in a case in which the control section 6 does not designate a discharge section D[m] as a target discharge section Dtg in a single unit period Tu, a connection circuit Ux[m] electrically connects a discharge section D[m] and the driving signal creation section 51 as a result of reaching the first connection state throughout the entirety of the single unit period Tu.

The control section 6 outputs a connection control signals Sw for controlling the connection state of each connection circuit Ux, to each connection circuit Ux. More specifically, in a case in which a discharge section D[m] is designated as a target discharge section Dtg in a single unit period Tu, the control section 6 supplies, to a connection circuit Ux[m], a connection control signal Sw[m] according to which, among the single unit period Tu, the connection circuit Ux[m] reaches the first connection state in periods other than the detection period Td, and reaches the second connection state in the detection period Td. Therefore, in a case in which a discharge section D[m] is designated as a target discharge section Dtg in a single unit period Tu, among the single unit period Tu, a driving signal Vin[m] is supplied to a discharge section D[m] from the driving signal creation section 51 in periods other than the detection period Td, and the residual vibration signal Vout is supplied to the detection unit 8 from the discharge section D[m] in the detection period Td.

In addition, in a case in which a discharge section D[m] is not designated as a target discharge section Dtg in a single unit period Tu, the control section 6 supplies, to a connection circuit Ux[m], a connection control signal Sw[m] according to which the connection circuit Ux[m] retains the first connection state throughout the entirety of the single unit period Tu.

Additionally, in the present embodiment, as shown in FIG. 18, a case in which the ink jet printer 1 is provided with a single detection unit 8 for the M discharge sections D, and, in addition, in which the detection unit 8 is only capable of detecting residual vibrations that are generated in a single discharge section D in a single unit period Tu, is assumed. That is, the control section 6 according to the present embodiment designates a single discharge section D from among the M discharge sections D as a target discharge section Dtg in a single unit period Tu.

4.3. Detection Unit

In the abovementioned manner, the detection unit 8 that is shown in FIG. 18 creates the shaped waveform signal Vd on the basis of the residual vibration signal Vout. In the abovementioned manner, the shaped waveform signal Vd is a signal according to which a process, such as a noise component being removed by amplifying the amplitude, is carried out on the residual vibration signal Vout.

For example, the detection unit 8 includes a negative feedback type amp for amplifying the residual vibration signal Vout, a low-pass filter for dampening a high frequency component of the residual vibration signal Vout, and a voltage follower that outputs a low impedance shaped waveform signal Vd by converting the impedance.

4.4. Determination Unit

The determination unit 4 determines the discharge state of the ink in a discharge section D on the basis of the shaped waveform signal Vd that the detection unit 8 outputs, and creates determination information RS, which shows a corresponding determination result.

As shown in FIG. 18, the determination unit 4 is provided with a characteristic information creation section 41, and a determination information creation section 42.

The characteristic information creation section 41 creates characteristic information Info on the basis of the shaped waveform signal Vd. In this instance, characteristic information Info is information that shows characteristics of the residual vibrations that are generated in a target discharge section Dtg, and for example, is a collective term for information such as the frequency (a duration of a single period), the amplitude and the phase of the corresponding residual vibrations. In the present embodiment, as one example, a case in which the characteristic information Info is information that is formed from period length information NTc that shows a duration Tc of a single period of the shaped waveform signal Vd, and an amplitude flag Flag that shows that the shaped waveform signal Vd has an amplitude that is a predetermined amplitude or more, is assumed. That is, in the present embodiment, the duration of a single period of the residual vibrations that are generated in a target discharge section Dtg is approximately represented by the duration Tc that the period length information NTc shows. In addition, in the present embodiment, whether or not the shaped waveform signal Vd has an amplitude of an extent that is required in measurement of the duration Tc, is shown by the amplitude flag Flag.

The determination information creation section 42 determines the discharge state of the ink in a target discharge section Dtg on the basis of the period length information NTc and the amplitude flag Flag that the characteristic information creation section 41 creates, and outputs the determination information RS, which shows the corresponding determination result.

As shown in FIG. 18, in addition to the shaped waveform signal Vd, which the detection unit 8 outputs, a mask signal Msk, the clock signal CL (not illustrated in FIG. 18), a signal that includes a threshold value potential Vth-C, which is a potential at which the shaped waveform signal Vd has an amplitude of a medium level, a signal that includes a threshold value potential Vth-O, which is a higher potential than the threshold value potential Vth-C, and a signal that includes a threshold value potential Vth-U, which is a lower potential than the threshold value potential Vth-C, are supplied to the characteristic information creation section 41 from the control section 6.

Figure 19:
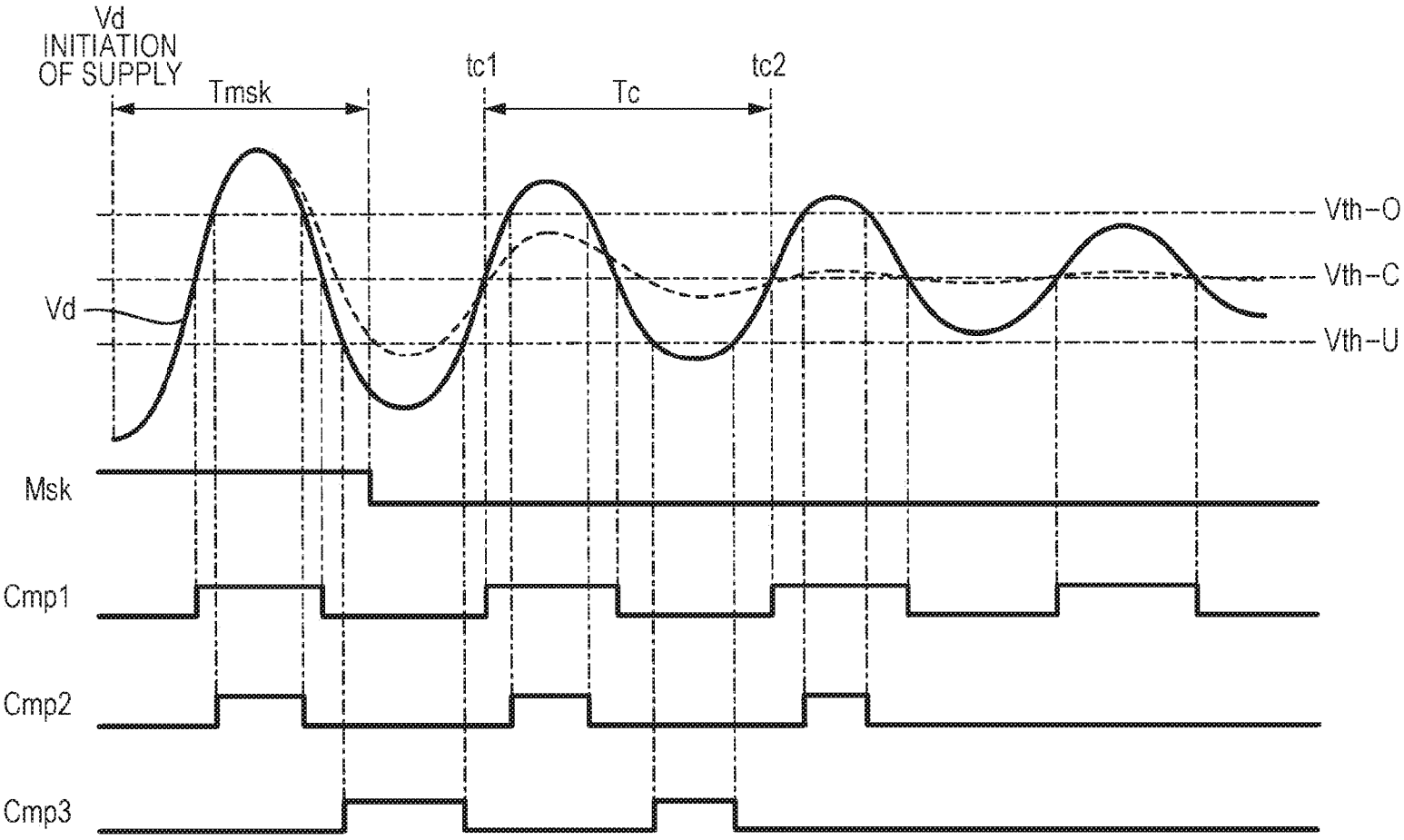
FIG. 19 is a timing chart for describing actions of a characteristic information creation section.

FIG. 19 is a timing chart that shows actions of the characteristic information creation section 41.

As shown in the drawing, the characteristic information creation section 41 creates a comparison signal Cmp1 which reaches a high level in a case in which the potential of the shaped waveform signal Vd is the threshold value potential Vth-C or more. In addition, the characteristic information creation section 41 creates a comparison signal Cmp2 which reaches a high level in a case in which the potential of the shaped waveform signal Vd is the threshold value potential Vth-O or more. In addition, the characteristic information creation section 41 creates a comparison signal Cmp3 which reaches a high level in a case in which the potential of the shaped waveform signal Vd is less than the threshold value potential Vth-U.

The mask signal Msk is a signal which reaches a high level during a predetermined period Tmsk in each unit period Tu after the supply of the shaped waveform signal Vd from the detection unit 8 is initiated. In the present embodiment, by acquiring the characteristic information Info with the shaped waveform signal Vd after the passage of the period Tmsk from the start of the supply of the shaped waveform signal Vd set as the only target, it is possible to reduce the effect of a noise component that is superimposed immediately after the start of the residual vibrations.

The characteristic information creation section 41 is provided with a counter (not illustrated in the drawings). The counter initiates counting of the clock signal CL at time point tc1, at which the potential of the shaped waveform signal Vd initially becomes equivalent to the threshold value potential Vth-C after the mask signal Msk falls to a low level, ends counting of the clock signal CL at a time point tc2, at which the potential of the shaped waveform signal Vd becomes equivalent to the threshold value potential Vth-C for the third time, and outputs an obtained count value as the period length information NTc. That is, the duration Tc from the time point tc1 to the time point tc2, which the period length information NTc shows, is a duration of a single period of the shaped waveform signal Vd.

Given that, in a case in which the amplitude of the shaped waveform signal Vd is small in the manner that is shown by the broken line in FIG. 19, the likelihood that it will not be possible to measure the duration Tc correctly, is increased. In addition, in a case in which the amplitude of the shaped waveform signal Vd is small, for example, the likelihood that a discharge abnormality, such as there being a state in which it is not possible to discharge the ink due to the ink not being injected into the cavity 320, will occur in a target discharge section Dtg, is increased.

In such an instance, the characteristic information creation section 41 according to the present embodiment determines whether or not the shaped waveform signal Vd has an amplitude that is a predetermined amplitude or more, and creates the amplitude flag Flag that shows the corresponding detection result. More specifically, the characteristic information creation section 41 sets the amplitude flag Flag to "1" in a case in which the potential of the shaped waveform signal Vd reaches a potential that is the threshold value potential Vth-O or more, and reaches a potential that is the threshold value potential Vth-U or less in a period from the time point tc1 to the time point tc2, and sets the amplitude flag Flag to "0" cases other than the above.

The determination information creation section 42 that is shown in FIG. 18 determines the discharge state of the ink in a target discharge section Dtg on the basis of the characteristic information Info that the characteristic information creation section 41 outputs, and creates determination information RS that shows the corresponding determination result.

FIG. 20 is an explanatory diagram for describing the contents of the determination in the determination information creation section 42.

As shown in the drawing, the determination information creation section 42 compares the duration Tc, which the period length information NTc shows, with three threshold values Tth1, Tth2, and Tth3, or a portion of the three threshold values.

In this instance, the threshold value Tth1 is a value for showing a boundary between a duration of a single period of residual vibrations in a case in which the discharge state is normal, and a duration of a single period of residual vibrations in a case in which air bubble is generated inside the cavity 320 and the frequency of the residual vibrations is higher than a case in which the discharge state is normal.

In addition, the threshold value Tth2 is a value that represents a longer duration than that of the threshold value Tth1, and is a value for showing a boundary between a duration of a single period of residual vibrations in a case in which the discharge state is normal, and a duration of a single period of residual vibrations in a case in which foreign matter is attached to the vicinity of the outlet of the nozzle N and the frequency of the residual vibrations is lower than a case in which the discharge state is normal.

In addition, the threshold value Tth3 is a threshold value that represents a duration that is longer than the threshold value Tth2, and is a value for showing a boundary between a duration of a single period of the residual vibrations in a case in which the frequency of the residual vibrations is even lower than a case in which foreign matter is attached to the vicinity of the outlet of a nozzle N due to thickening or fixing of the ink in the vicinity of the of the nozzle N, and a duration of a single period of the residual vibrations in a case in which foreign matter is attached to the vicinity of the outlet of a nozzle N.

As shown in FIG. 20, in a case in which the value of the amplitude flag Flag is "1", and the duration Tc, which the period length information NTc shows, satisfies "Tth1≤Tc≤Tth2", the determination information creation section 42 determines that the discharge state of the ink in the target discharge section Dtg is normal, and sets a value "1", which shows that the discharge state is normal, to the determination information RS.

In addition, in a case in which the value of the amplitude flag Flag is "1", and the duration Tc, which the period length information NTc shows, satisfies "Tc<Tth1", the determination information creation section 42 determines that a discharge abnormality has occurred as a result of an air bubble being generated in the cavity 320, and sets a value "2", which shows that a discharge abnormality has occurred due to an air bubble, to the determination information RS.

In addition, in a case in which the value of the amplitude flag Flag is "1", and the duration Tc, which the period length information NTc shows, satisfies "Tth2<Tc≤Tth3", the determination information creation section 42 determines that a discharge abnormality has occurred as a result of foreign matter being attached to the vicinity of an outlet of a nozzle N, and sets a value "3", which shows that a discharge abnormality has occurred due to the attachment of foreign matter, to the determination information RS.

In addition, in a case in which the value of the amplitude flag Flag is "1", and the duration Tc, which the period length information NTc shows, satisfies "Tth3<Tc", the determination information creation section 42 determines that a discharge abnormality has occurred as a result of thickening of the ink inside the cavity 320, and sets a value "4", which shows that a discharge abnormality has occurred due to thickening of the ink, to the determination information RS.

In addition, in a case in which the value of the amplitude flag Flag is "0", the determination information creation section 42 sets a value "5", which shows that a discharge abnormality has occurred for some reason or another such as ink not being injected, to the determination information RS.

In the abovementioned manner, the determination information creation section 42 determines the discharge state in the discharge sections D on the basis of the period length information NTc and the amplitude flag Flag, and creates the determination information RS, which shows the corresponding determination result.

The control section 6 stores the determination information RS, which the determination information creation section 42 outputs, in the memory section 60 in association with a stage number of a target discharge section Dtg that corresponds to the corresponding determination information RS. Therefore, it is possible to ascertain which discharge section D among the M discharge sections D a discharge abnormality has occurred in. As a result of this, by taking the number of discharge sections D in which a discharge abnormality has occurred, and the positions of the discharge sections D in which a discharge abnormality has occurred into consideration, it is possible to execute a maintenance process at a suitable timing. Accordingly, it is possible to prevent a circumstance in which the image quality, which is formed in the printing process deteriorates as a result of a discharge abnormality in the discharge sections D.

5. Inspection Waveform

Next, the inspection waveform PT will be described with reference to FIGS. 21 to 24.

Figure 21:
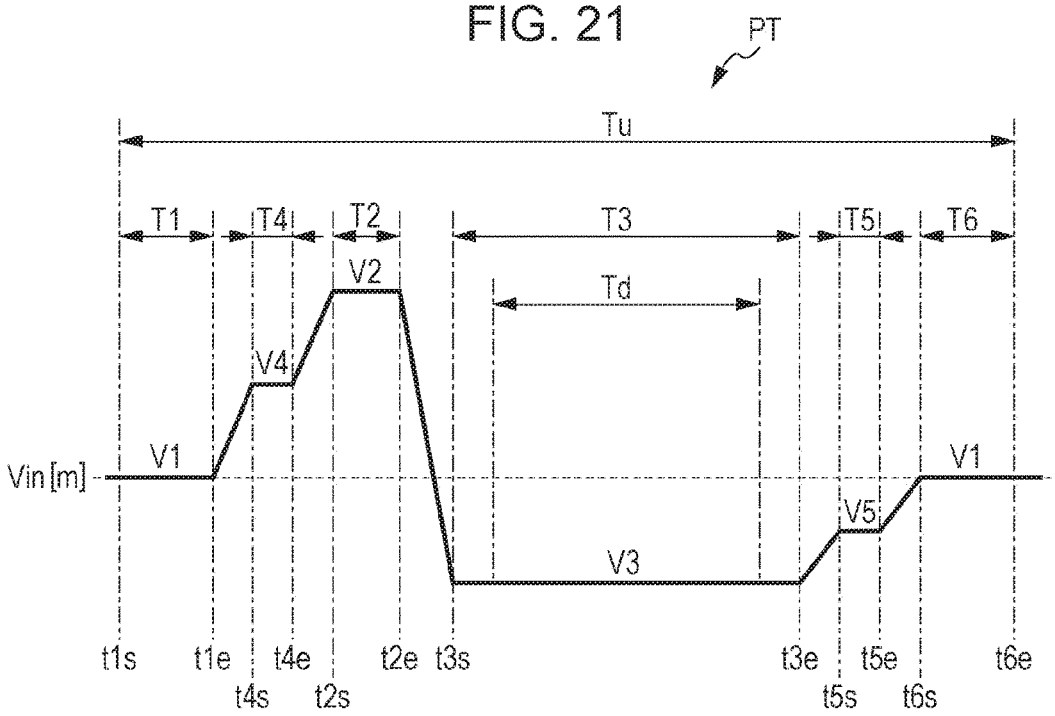
FIG. 21 is a timing chart that shows a waveform.

FIG. 21 is a timing chart for describing the details of the waveform PT according to the present embodiment.

As shown in the drawing, in the waveform PT, the potential in a period T1 (an example of a "first period") from a time point t1*s*, which is an initiation time point of a unit period Tu, to a time point t1*e*, is the potential V1, the potential in a period T2 (an example of a "second period") from a time point t2*s*, which is after the time point t1*e*, to a time point t2*e*, is the potential V2, and the potential in a period T3 (an example of a "third period") from a time point t3*s*, which is after the time point t2*e*, to a time point t3*e*, is the potential V3. In addition, in the waveform PT, the potential in a period T4 (an example of a "fourth period") from a time point t4*s*, which is after the time point t1*e*, to a time point t4*e*, which is before the time point t2*s*, is a potential V4 (an example of a "fourth potential"), the potential in a period T5 (an example of a "fifth period") from a time point t5*s*, which is after the time point t3*e*, to a time point t5*e*, which is before a time point t6*e*, which is an end time point of a unit period Tu, is a potential V5 (an example of a "fifth potential"), and the potential in a period T6 (an example of a "sixth period") from a time point t6*s*, which is after the time point t5*e*, to the time point t6*e* is the potential V1.

In this instance, as shown in FIG. 21, the potential V4 is a potential that satisfies "V1<V4<V2", and the potential V5 is a potential that satisfies "V3<V5<V1". In addition, in the abovementioned manner, the potentials V1 to V3 are established so a relationship "(V2−V1)>(V1−V3)" is satisfied.

Additionally, as is also illustrated in FIG. 16, the period T3 is a period in which the detection period Td is provided. In other words, the detection period Td is a period of a portion of the period T3. More specifically, in the example that is shown in FIG. 21, residual vibrations that are generated in a target discharge section Dtg are detected in a period in which the driving signal Vin with the waveform PT (the driving waveform signal Com-C) that is supplied to the corresponding target discharge section Dtg, is maintained at the potential V3.

Figure 22:
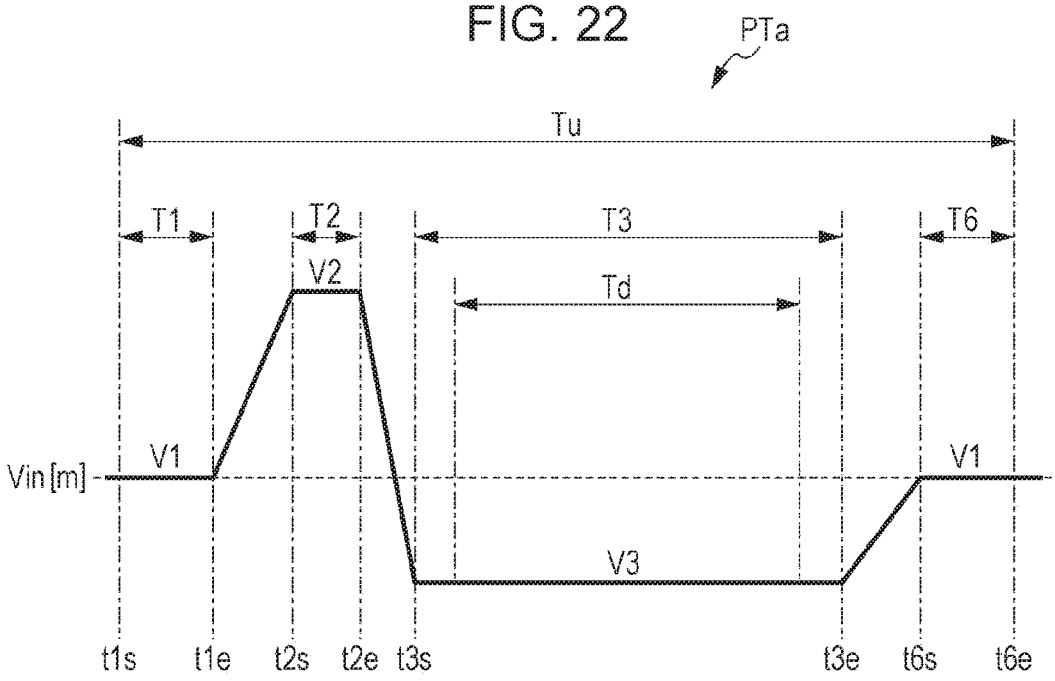
FIG. 22 is a timing chart that shows a waveform.

Additionally, the waveform PT that is shown in FIG. 21 is merely an example of an inspection waveform according to the present embodiment. In the manner illustrated by way of example as a waveform PTa that is shown in FIG. 22, the inspection waveform according to the present embodiment may include a waveform that, at least, is set to a potential V1 in a period T1, is set to a potential V2 in a period T2, which is initiated after the end of the period T1, is set to a potential V3 in a period T3, which is initiated after the end of the period T2, and thereafter, is set to the potential V1 at the end of the unit period Tu. In other words, except for the period T1, the period T2, the period T3 and the end of a unit period Tu, the potential in periods of the unit period Tu may be any potential. However, it is preferable that the potential from the end of the period T1 up to the start of the period T2 is the potential V1 or more and the potential V2 or less, the potential from the end of the period T2 up to the start of the period T3 is the potential V2 or less and the potential V3 or more, and the potential from the end of the period T3 to the end of a unit period Tu is the potential V3 or more and the potential V1 or less.

A waveform PTx, which is an inspection waveform according to a comparative example 1, and a waveform PTy, which is an inspection waveform according to a comparative example 2, will be described in order to describe a result of generating residual vibrations in a target discharge section Dtg using such a waveform PT or waveform PTa.

Figure 23:
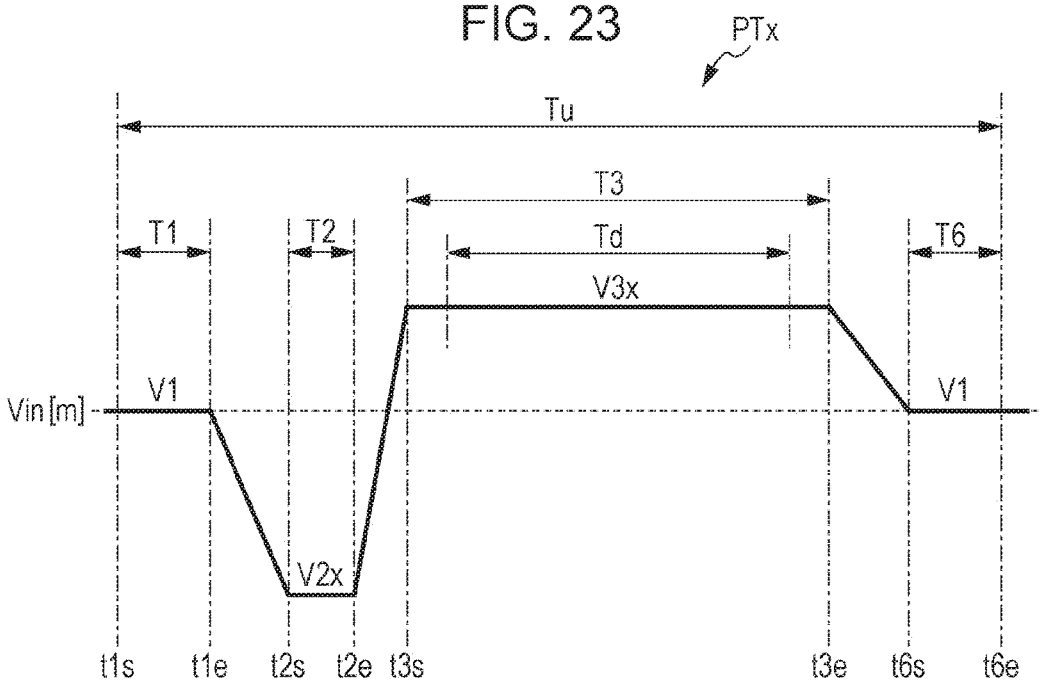
FIG. 23 is a timing chart that shows a waveform.

FIG. 23 is a timing chart for describing the waveform PTx according to comparative example 1. As shown in the drawing, the waveform PTx is a waveform in which the waveform PTa is vertically reversed centering on the potential V1. More specifically, the waveform PTx that is set to a potential V1 in a period T1, is set to a potential V2*x* in a period T2, is set to a potential V3*x* in a period T3, and is set to the potential V1 in a period T6. In this instance, a case in which the potential V2*x* is a lower potential than the potential V1, and a difference in potential between the potential V1 and the potential V2*x* is a potential that is equivalent to a difference in potential between the potential V2 and the potential V1, is assumed. In addition, a case in which the potential V3*x* is a higher potential than the potential V1, and a difference in potential between the potential V3*x* and the potential V1 is a potential that is equivalent to a difference in potential between the potential V1 and the potential V3, is assumed.

In contrast to the piezoelectric element 300 and the vibration plate 310 being displaced in the +Z direction and the volume of the cavity 320 increasing in an interval from the end of the period T2 up to the start of the period T3 in the waveform PT and the waveform PTa according to the present embodiment, in the waveform PTx according to comparative example 1, the piezoelectric element 300 and the vibration plate 310 are displaced in the −Z direction and the volume of the cavity 320 decreases in an interval from the end of the period T2 up to the start of the period T3. Therefore, in a case in which a target discharge section Dtg is driven by a driving signal Vin that includes the waveform PTx according to comparative example 1, in comparison with a case in which a target discharge section Dtg is driven by a driving signal Vin that includes the waveform PT or the waveform PTa according to the present embodiment, the likelihood that ink will be discharged from a nozzle N in the period T3, is increased. In particular, since the amplitude of residual vibrations that are detected in the period T3 are larger, the potential of the driving signal Vin changes greatly in an interval from the end of the period T2 up to the start of the period T3, and in a case in which the piezoelectric element 300 is displaced greatly, the likelihood that ink will be discharged from a nozzle N is increased in comparative example 1.

However, in a case in which ink is discharged in the discharge state determination process, ink is consumed for an application other than the original application of the ink of the formation of images. In addition, in a case in which ink is discharged in the discharge state determination process, the likelihood that a recording sheets P will be stained by ink, is increased. Therefore, in a case in which ink is discharged in the discharge state determination process, countermeasures for preventing staining due to the ink that is discharged in the discharge state determination process, such as covering the head unit 10 with a cap during execution of the discharge state determination process, are necessary, and the labor associated with the discharge state determination process is increased.

In contrast to this, in the waveform PT and the waveform PTa according to the present embodiment, since the piezoelectric element 300 and the vibration plate 310 are displaced in the +Z direction, and the volume of the cavity 320 increases in an interval from the end of the period T2 up to the start of the period T3, it is possible to keep the likelihood that ink will be discharged from a nozzle N low in comparison with comparative example 1 even in a case in which a difference in potential between the potential V2 and the potential V3 is set to be large.

Figure 24:
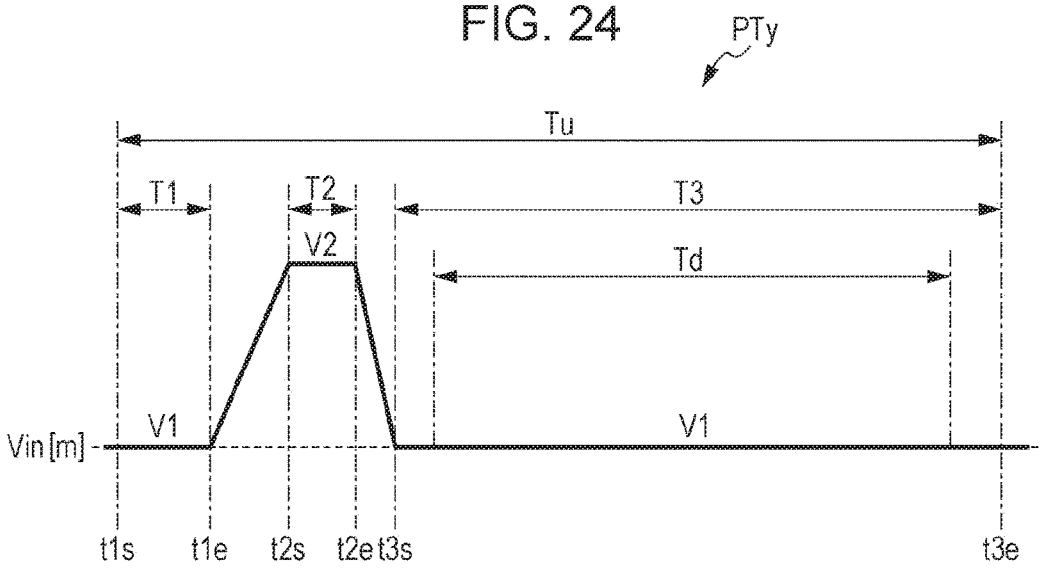
FIG. 24 is a timing chart that shows a waveform.

FIG. 24 is a timing chart for describing the waveform PTy according to comparative example 2. As shown in FIG. 24, except for the fact that a time point t3*e*, which is an end time point of the period T3, is an end time point of a unit period Tu, and the fact that a potential in the period T3 is the potential V1, the waveform PTy is the same as the waveform PTa that is shown in FIG. 22.

In the waveform PTy according to comparative example 2, since the piezoelectric element 300 and the vibration plate 310 are displaced in the +Z direction, and the volume of the cavity 320 increases in an interval from the end of the period T2 up to the start of the period T3, in the same manner as the cases of the waveform PT and the waveform PTa according to the present embodiment, the likelihood that ink will be discharged from a nozzle N.

However, in the waveform PTy according to comparative example 2, a difference in potential between a potential in the period T2 and a potential in the period T3 is merely "V2−V1", and is smaller than the difference in potential "V2−V3" of the cases of the waveform PT and the waveform PTa according to the present embodiment. Therefore, in comparative example 2, the amplitude of residual vibrations that are generated in a target discharge section Dtg in the period T3 is smaller than that in a case of the present embodiment, and the accuracy of the determination of the discharge state of the ink in a target discharge section Dtg is reduced.

In contrast to this, in the waveform PT and the waveform PTa according to the present embodiment, in an interval from the end of the period T2 up to the start of the period T3, the potential of the driving signal Vin is changed from the potential V2, which is a higher potential than the reference potential V1 to the potential V3, which is a lower potential than the reference potential V1. Therefore, in the waveform PT and the waveform PTa according to the present embodiment, it is possible to make the amplitude of residual vibrations that are generated in a target discharge section Dtg in the period T3 larger than the case of comparative example 2.

In addition, in the waveform PTy according to comparative example 2, the and time of the period T3 is set to be the end time of a unit period Tu. In other words, in comparative example 2, the likelihood that the residual vibrations that are generated in a target discharge section Dtg in the period T3 will not be sufficiently dampened at the end time of a unit period Tu, is high.

In contrast to this, in the waveform PT and the waveform PTa according to the present embodiment, the period T6 is provided after the end of the period T3, and the potential of the driving signal Vin is changed from the potential V3 to the potential V1 in an interval from the end of the period T3 up to the start of the period T6. Further, as a result of a change in potential in an interval from the end of the period T3 up to the start of the period T6, residual vibrations that are generated in a target discharge section Dtg in the period T3 are suppressed, and therefore, it is possible to reduce the amplitude thereof. Therefore, in a case in which a target discharge section Dtg is driven by the waveform PT or the waveform PTa according to the present embodiment, in comparison with a case in which a target discharge section Dtg is driven by the waveform PTy according to comparative example 2, in addition to the fact that it is possible to make the amplitude of residual vibrations that are generated in a target discharge section Dtg in the period T3 larger, it is possible to make the amplitude of residual vibrations that remain in a target discharge section Dtg at the end time of a unit period Tu smaller. In other words, in a case in which the discharge state determination process is executed using the waveform PT or the waveform PTa in a single unit period Tu, it is possible to make an effect that residual vibrations, which are generated in a target discharge section Dtg in the corresponding discharge state determination process, bring about in a unit period Tu that follows the single unit period Tu (or a likelihood that residual vibrations will remain), smaller. As a result of this, in a case in which the printing process or the discharge state determination process is executed in a unit period Tu that follows the single unit period Tu, it is possible to reduce the likelihood that residual vibrations, which are generated in the single unit period Tu, will have an effect on the printing process or the discharge state determination process, which is executed in the subsequent unit period Tu, as noise.

Additionally, in the present embodiment, the waveform PT includes the period T4, in which the potential V4 is held, and the period T5, in which the potential V5 is held. Therefore, it is possible to make displacement of the piezoelectric element 300 in the −Z direction, according to which the volume of the cavity 320 becomes smaller, gradual in a stepwise manner. More specifically, it is possible to make both displacement of the piezoelectric element 300 from the end of the period T1 up to the start of the period T2, and displacement of the piezoelectric element 300 from the end of the period T3 up to the start of the period T6 gradual in a stepwise manner. As a result of this, it is possible to keep vibrations that are generated in a target discharge section Dtg after the piezoelectric element 300 is displaced in the −Z direction, low. That is, in a case in which the discharge state determination process is executed by driving a target discharge section Dtg using the waveform PT, it is possible to keep the likelihood that ink will be discharged from a nozzle N of the target discharge section Dtg even lower than in a case in which the discharge state determination process is executed by driving a target discharge section Dtg using the waveform PTa.

6. Conclusion of Embodiment

In the manner described above, in the present embodiment, the piezoelectric element 300 is displaced in the +Z direction in a manner in which the volume of the cavity 320 becomes larger in a period from the end of the period T2 up to the start of the period T3. Therefore, even in a case in which residual vibrations having a large amplitude are detected in the detection period Td, which is provided in the period T3, it is possible to keep a risk that ink will be discharged from a nozzle N low. Accordingly, in the present embodiment, it is possible to achieve a reduction in a consumption amount of ink, a reduction in the likelihood of staining by the ink, and accurate determination of a discharge state.

In addition, in the present embodiment, since the potential of the driving signal Vin is changed so that residual vibrations, which are generated in a target discharge section Dtg, are suppressed after the period T3, even in a case in which residual vibrations with a large amplitude are generated in a target discharge section Dtg in the period T3, it is possible to make an effect that the corresponding residual vibrations bring about after the end of the unit period Tu sufficiently small. As a result of this, it is possible to achieve accurate determination of a discharge state in a target discharge section Dtg, and a reduction in the effect that residual vibrations bring about in a subsequent unit period Tu.

In addition, in the present embodiment, the potentials V1 to V3 are established so a relationship "(V2−V1)>(V1−V3)" is satisfied. Therefore, it is possible to keep vibrations that are generated in a target discharge section Dtg as a result of the potential of the driving signal Vin changing from the potential V3 to the potential V1 after the end of the period T3, lower than vibrations that are generated in a target discharge section Dtg as a result of the potential of the driving signal Vin changing from the potential V1 to the potential V2. As a result of this, it is possible to keep the amplitude of residual vibrations that are generated in a target discharge section Dtg after a unit period Tu, low.

B. MODIFICATION EXAMPLES

Each of the abovementioned forms can be modified in a variety of ways. Aspects of specific modifications are illustrated by way of example below. Two or more aspects chosen arbitrarily from the following examples can be combined as appropriate within a range in which the aspects do not contradict one another. Additionally, in the Modification Examples that are illustrated by way of example below, the reference symbols that are referred to in the abovementioned description are reused for features for which the actions or functions thereof are equivalent to those of the embodiment, and the respective detailed descriptions thereof are omitted as appropriate.

Modification Example 1

In the above-mentioned embodiment, a difference in potential of the waveform PT and the waveform PTa between the potential V2, which is the highest potential, and the potential V3, which is the lowest potential, is larger than a difference in potential between the highest potential and the lowest potential of the waveform PA2, but the invention is not limited to such an aspect, and a difference in potential between the potential V2 and the potential V3 in the waveform PT and the waveform PTa may be a difference in potential between the highest potential and the lowest potential of the waveform PA2, or less. Furthermore, a difference in potential between the potential V2 and the potential V3 in the waveform PT and the waveform PTa may be more, less or equal to a difference in potential between the highest potential and the lowest potential of the waveform PA1.

In addition, in the above-mentioned embodiment, a case in which the potentials V1 to V3 are "V3<V1<V2" is illustrated by way of example, but this is merely an example, and it is sufficient as long as the potentials V1 to V3 satisfy at least a first condition of the volume of the cavity 320 in the period T2, in which the driving signal Vin is the potential V2, being greater than the volume of the cavity 320 in the period T3, in which the driving signal Vin is the potential V3, and a second condition of the potential V1 being a potential that is between the potential V2 and the potential V3. For example, in a case in which an electrode in the piezoelectric element 300 to which the driving signal Vin is supplied, is the lower section electrode 301, the high and low relationship of the potentials according to the potentials V1 to V3 may be reversed.

Modification Example 2

In the above-mentioned embodiment and modification example, the characteristic information Info includes the period length information NTc and the amplitude flag Flag, but the invention is not limited to such an aspect, and the characteristic information Info may be any kind of information as long as the characteristic information Info is information that shows an extent of a difference in shape between a waveform of residual vibrations that are detected from a target discharge section Dtg in practice, and a waveform of residual vibrations that are expected to be detected in a case in which the discharge state of the target discharge section Dtg is normal. For example, the characteristic information Info may include information that represents the phase of the shaped waveform signal Vd, or may include information that represents the signal level and amplitude of the shaped waveform signal Vd.

Modification Example 3

In the discharge state determination process according to the above-mentioned embodiment and modification examples, it is possible to execute determination of whether or not the discharge state in a target discharge section Dtg is normal, and determination for specifying a cause of a discharge abnormality in a target discharge section Dtg, but the invention is not limited such an aspect, and may execute at least determination of whether or not the discharge state in a target discharge section Dtg is normal. In other words, in the above-mentioned embodiment and modification examples, a case in which five values of "1" to "5" are possible, is illustrated by way of example, but the determination information RS may be information of two values that show "1", which shows that the discharge state in a target discharge section Dtg is normal, and any value other than "1", which shows that the discharge state in a target discharge section Dtg is abnormal. In other words, it is suitable as long as the ink jet printer 1 is capable of determining whether or not the discharge state in each discharge section D is normal, and it is not necessary to be capable of specifying a cause of a discharge abnormality in a case in which there is a discharge abnormality in each discharge section D.

Modification Example 4

In the above-mentioned embodiment and modification examples, description was given with a case in which the ink jet printer 1 is provided with a single head unit 10 being illustrated by way of example, but the ink jet printer 1 may be provided with a plurality of head units 10. In this case, the plurality of head units 10 may be provided so as the correspond to the plurality of ink cartridges 31, which are provided in the ink jet printer 1, on a one-to-one basis.

In addition, in the above-mentioned embodiment and modification examples, description was given with a case in which the ink jet printer 1 is provided with a single determination unit 4 being illustrated by way of example, but the ink jet printer 1 may be provided with a plurality of determination units 4. In this case, the plurality of determination units 4 may be provided so as the correspond to a plurality of head units 10 on a one-to-one basis.

Modification Example 5

The ink jet printer 1 according to the abovementioned embodiment and modification examples, is a line printer in which nozzle rows Ln are provided in a manner in which the range YNL includes the range YP, but the invention is not limited to such an aspect, and the ink jet printer 1 may be a serial printer in which the recording head 3 executes a printing process by reciprocating in a Y axis direction.

Modification Example 6

The ink jet printer 1 according to the abovementioned embodiment and modification examples is capable of discharging the four colors of CMYK, but the invention is not limited to such an aspect, and the ink jet printer 1 may be capable of discharging at least one or more color of ink, and in addition the colors of the ink may be colors other than CMYK. In addition, the ink jet printer 1 according to the abovementioned embodiment and modification examples is provided with four nozzle rows Ln, but it is sufficient as long as the ink jet printer 1 is provided with at least one nozzle row Ln or more.

Modification Example 7

In the abovementioned embodiment and modification examples, the driving waveform signal Com includes the signals of three systems of the driving waveform signals Com-A, Com-B and Com-C, but the invention is not limited to such an aspect, and it is sufficient as long as the driving waveform signal Com includes the signals of one or more systems.

Additionally, it is necessary supply a driving signal Vin having the waveform PA1, or the like, for driving the discharge sections D in the printing process, and a driving signal Vin having the waveform PT, or the like, for driving the discharge sections D in the discharge state determination process, to each discharge section D. Therefore, for example, in a case in which the driving waveform signal Com only includes a signal of a single system, a plurality of unit periods Tu, which are action periods of the ink jet printer 1, may be classified into a unit period Tu for executing the printing process and a unit period Tu for executing the discharge state determination process, and the driving waveform signal Com may be switched in each unit period Tu, and an example of such switching includes setting the driving waveform signal Com to a waveform, such as the waveform PA1, for executing the printing process in the unit period Tu for executing the printing process, and setting the driving waveform signal Com to a waveform, such as the waveform PT, for executing the discharge state determination process in the unit period Tu for executing the discharge state determination process.

In addition, in the above-mentioned embodiment and modification examples, the unit period Tu includes the two control periods Ts1 and Ts2, but the invention is not limited to such an aspect, and the unit period Tu may be formed from a single control period Ts, of may include three or more control periods Ts.

In addition, in the abovementioned embodiment and modification examples, a printing signal SI[m] is a 3-bit signal, but the bit number of a printing signal SI[m] may be determined as appropriate depending on a gradation that should be displayed, the number of control period Ts that are included in a unit period Tu, the number of systems of signals that are included in the driving waveform signal Com, or the like.

Modification Example 8

In the above-mentioned embodiment and modification examples, the determination information creation section 42 us mounted as an electronic circuit, but may be mounted as a functional block, which is realized as a result of the CPU of the control section 6 acting in accordance with a control program. In the same manner, the characteristic information creation section 41 may also be mounted as a functional block, which is realized as a result of the CPU of the control section 6 acting in accordance with a control program.

In addition, in the above-mentioned embodiment and modification examples, the determination unit 4 is provided separately to the head unit 10, but the determination unit 4 may be provided as an aspect that is installed in the head unit 10.

What is claimed is:

1. A liquid discharging apparatus comprising:

a driving signal creation section that creates a driving signal;

a discharge section provided with a piezoelectric element that is displaced depending on changes in potential of the driving signal, a pressure chamber that causes changes in an internal volume thereof depending on displacement of the piezoelectric element, and a nozzle that is in communication with the pressure chamber, and is configured to discharge a liquid with which inside of the pressure chamber is filled depending on changes in the internal volume of the pressure chamber; and a detection section that is configured to detect residual vibrations that are generated in the discharge section after displacement of the piezoelectric element, wherein the driving signal creation section is configured to create a signal having an inspection waveform of which a potential of a first period is a first potential, a potential of a second period, which is after the first period, is a second potential, and a potential of a third period, which is after the second period, is a third potential, as the driving signal, wherein the first potential is a potential that is between the second potential and the third potential, wherein the internal volume of the pressure chamber in a case in which the driving signal is the second potential is smaller than the internal volume of the pressure chamber in a case in which the driving signal is the third potential, and wherein a difference in potential between the first potential and the second potential is greater than a difference in potential between the first potential and the third potential.

2. The liquid discharging apparatus according to claim 1, wherein the detection section detects residual vibrations, which are being generated in the discharge section, in at least a period of a portion of the third period.

3. The liquid discharging apparatus according to claim 1, wherein, in the inspection waveform, a potential of a fourth period, which is a period of a portion from the end of the first period up to the start of the second period, is a fourth potential that is between the first potential and the second potential.

4. The liquid discharging apparatus according to claim 1, wherein, in the inspection waveform, a potential of a fifth period, which is after the third period, is a fifth potential, and a potential of a sixth period, which is after the fifth period, is the first potential, and wherein the fifth potential is a potential that is between the first potential and the third potential.

5. The liquid discharging apparatus according to claim 1, wherein, in the inspection waveform, a potential of a sixth period, which is after the third period, is the first potential.

6. A head unit comprising:

a driving signal creation section that creates a driving signal;

a discharge section provided with a piezoelectric element that is displaced depending on changes in potential of the driving signal, a pressure chamber that causes changes in an internal volume thereof depending on displacement of the piezoelectric element, and a nozzle that is in communication with the pressure chamber, and is configured to discharge a liquid with which inside of the pressure chamber is filled depending on changes in the internal volume of the pressure chamber; and a detection section that is configured to detect residual vibrations that are generated in the discharge section after displacement of the piezoelectric element, wherein the driving signal creation section is configured to create a signal having an inspection waveform of which a potential of a first period is a first potential, a potential of a second period, which is after the first period, is a second potential, and a potential of a third period, which is after the second period, is a third potential, as the driving signal, wherein the first potential is a potential that is between the second potential and the third potential, wherein the internal volume of the pressure chamber in a case in which the driving signal is the second potential is smaller than the internal volume of the pressure chamber in a case in which the driving signal is the third potential, and wherein a difference in potential between the first potential and the second potential is greater than a difference in potential between the first potential and the third potential.

7. A control method of a liquid discharging apparatus provided with a discharge section including a piezoelectric element that is displaced depending on changes in potential of a driving signal, a pressure chamber that causes changes in an internal volume thereof depending on displacement of the piezoelectric element, and a nozzle that is in communication with the pressure chamber, and is configured to discharge a liquid with which inside of the pressure chamber is filled depending on changes in the internal volume of the pressure chamber, and a detection section that is configured to detect residual vibrations that are generated in the discharge section after displacement of the piezoelectric element, the method comprising supplying a signal having an inspection waveform in which a potential of a first period is a first potential, a potential of a second period, which is after the first period, is a second potential, and a potential of a third period, which is after the second period, is a third potential, to the piezoelectric element as the driving signal, wherein the first potential is a potential that is between the second potential and the third potential, wherein the internal volume of the pressure chamber in a case in which the driving signal is the second potential is smaller than the internal volume of the pressure chamber in a case in which the driving signal is the third potential, and, wherein a difference in potential between the first potential and the second potential is greater than a difference in potential between the first potential and the third potential.

* * * * *